US012708817B2

(12) United States Patent
Engle et al.

(10) Patent No.: US 12,708,817 B2
(45) Date of Patent: Aug. 18, 2026

(54) DIMPLE PATTERNS FOR GOLF BALLS

(71) Applicant: Acushnet Company, Fairhaven, MA (US)

(72) Inventors: Courtney N. Engle, Fall River, MA (US); Michael R. Madson, Easton, MA (US)

(73) Assignee: Acushnet Company, Fairhaven, MA (US)

( * ) Notice: Subject to any disclaimer, the term of this patent is extended or adjusted under 35 U.S.C. 154(b) by 98 days.

(21) Appl. No.: 18/540,746

(22) Filed: Dec. 14, 2023

(65) Prior Publication Data

US 2024/0115905 A1 Apr. 11, 2024

Related U.S. Application Data

(63) Continuation-in-part of application No. 17/966,988, filed on Oct. 17, 2022, now Pat. No. 12,201,877, which is a continuation-in-part of application No. 17/526,709, filed on Nov. 15, 2021, now Pat. No. 11,691,052, which is a continuation-in-part of application No. 17/007,090, filed on Aug. 31, 2020, now Pat. No. 11,173,346, which is a continuation-in-part of application No. 16/587,455, filed on Sep. 30, 2019, now Pat. No. 10,758,783.

(51) Int. Cl.
*A63B 37/00* (2006.01)
*A63B 37/14* (2006.01)

(52) U.S. Cl.
CPC .... *A63B 37/0006* (2013.01); *A63B 37/00065* (2020.08); *A63B 37/0008* (2013.01); *A63B 37/0012* (2013.01); *A63B 37/0019* (2013.01); *A63B 37/002* (2013.01); *A63B 37/0021* (2013.01)

(58) Field of Classification Search
CPC ..... A63B 37/0006; A63B 37/0012; A63B 37/0019; A63B 37/002
See application file for complete search history.

(56) References Cited

U.S. PATENT DOCUMENTS

| | | | | |
|---|---|---|---|---|
| 5,722,903 | A * | 3/1998 | Moriyama | A63B 37/0021 473/384 |
| 5,759,116 | A | 6/1998 | Kasasima | |
| 5,890,974 | A | 4/1999 | Stiefel | |
| 5,890,975 | A | 4/1999 | Stiefel | |
| 6,315,685 | B1 | 11/2001 | Tavares | |
| 6,331,150 | B1 | 12/2001 | Ogg | |
| 6,540,625 | B2 | 4/2003 | Sajima | |
| 6,796,912 | B2 | 9/2004 | Dalton | |
| 7,163,472 | B2 | 1/2007 | Dalton | |
| 7,491,137 | B2 | 2/2009 | Bissonnette | |
| 7,641,572 | B2 | 1/2010 | Aoyama | |
| 7,887,439 | B2 | 2/2011 | Aoyama | |
| 9,782,628 | B2 * | 10/2017 | Madson | A63B 37/0006 |
| 10,758,783 | B1 * | 9/2020 | Madson | A63B 37/0012 |
| 10,814,179 | B1 | 10/2020 | Madson | |
| 11,045,692 | B2 | 6/2021 | Madson | |

(Continued)

*Primary Examiner* — John E Simms, Jr.

(57) ABSTRACT

A golf ball dimple pattern based on a square dipyramid is disclosed. In one specific aspect, the present disclosure provides for a square dipyramid dimple configuration including dimples having a catenary cross-sectional profile, and a combination of dimples having a circular plan shape and dimples having an elliptical plan shape.

12 Claims, 25 Drawing Sheets

(56) References Cited

U.S. PATENT DOCUMENTS

| | | | | |
|---|---|---|---|---|
| 11,173,346 | B2 | 11/2021 | Madson | |
| 11,691,052 | B2 | 7/2023 | Engle | |
| 12,201,877 | B2 * | 1/2025 | Madson | A63B 37/00065 |
| 2002/0034990 | A1 | 3/2002 | Sajima | |
| 2003/0114255 | A1 * | 6/2003 | Dalton | A63B 37/009 473/384 |
| 2003/0134695 | A1 | 7/2003 | Kasashima | |
| 2003/0190979 | A1 | 10/2003 | Sajima | |
| 2004/0157682 | A1 | 8/2004 | Morgan | |
| 2007/0135234 | A1 | 6/2007 | Nagasawa | |
| 2007/0173350 | A1 | 7/2007 | Ohama | |
| 2007/0173354 | A1 | 7/2007 | Sajima | |
| 2008/0220907 | A1 * | 9/2008 | Aoyama | A63B 37/002 473/383 |
| 2009/0124422 | A1 | 5/2009 | Sullivan | |
| 2009/0209367 | A1 | 8/2009 | Stefan | |
| 2011/0034274 | A1 * | 2/2011 | Sajima | A63B 37/00065 473/383 |
| 2014/0135146 | A1 * | 5/2014 | Madson | A63B 37/0006 473/383 |
| 2015/0375048 | A1 | 12/2015 | Sato | |
| 2016/0059081 | A1 | 3/2016 | Mimura | |
| 2017/0368417 | A1 | 12/2017 | Kamino | |
| 2018/0311533 | A1 | 11/2018 | Madson | |
| 2019/0105539 | A1 | 4/2019 | Madson | |
| 2021/0093925 | A1 * | 4/2021 | Madson | A63B 37/0012 |
| 2021/0093928 | A1 * | 4/2021 | Madson | A63B 37/0008 |
| 2022/0072385 | A1 * | 3/2022 | Engle | A63B 37/0007 |
| 2023/0050722 | A1 | 2/2023 | Madson | |

* cited by examiner

DIMPLE PATTERNS FOR GOLF BALLS

CROSS-REFERENCE TO RELATED APPLICATIONS

The present application is a continuation-in-part of U.S. patent application Ser. No. 17/966,988, filed Oct. 17, 2022, which is a continuation-in-part of U.S. patent application Ser. No. 17/526,709, filed Nov. 15, 2021, now U.S. Pat. No. 11,691,052, which is a continuation-in-part of U.S. patent application Ser. No. 17/007,090, filed Aug. 31, 2020, now U.S. Pat. No. 11,173,346, which is a continuation-in-part of U.S. patent application Ser. No. 16/587,455, filed Sep. 30, 2019, now U.S. Pat. No. 10,758,783, the entire disclosures of which are hereby incorporated herein by reference.

FIELD OF THE INVENTION

The present invention relates to golf ball dimple patterns based on a square dipyramid, wherein the dimples are arranged within four substantially identical triangular sections on each of the two hemispheres of the ball.

BACKGROUND OF THE INVENTION

Golf ball manufacturers make substantial efforts to maximize the aerodynamic efficiency of golf balls, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is placed on the tee or ground. In order to improve aerodynamic symmetry, many dimple patterns are based, for example, on geometric shapes, the five Platonic Solids, and the thirteen Archimedean Solids. Because the number of symmetric solid plane systems useful in designing dimple patterns is limited, it can be difficult to devise new symmetric patterns. Moreover, dimple patterns based on some geometric shapes result in less than optimal surface coverage and other disadvantageous dimple arrangements.

Thus, there is a continuing need for novel dimple patterns incorporating unique combinations of dimple properties such as size, shape, number, volume, or arrangement, in order to provide a golf ball that has distinctive characteristics.

SUMMARY OF THE INVENTION

The present invention is directed to a golf ball having a plurality of dimples arranged in a pattern defined by a square dipyramid projected on the spherical outer surface of the ball. The plurality of dimples comprises at least three different dimple diameters, including a minimum dimple diameter, a maximum dimple diameter, and at least one additional dimple diameter. The golf ball consists of two hemispheres separated by an equator. The two hemispheres have substantially identical dimple arrangements. Each hemispherical dimple arrangement consists of four triangular sections that are defined by projecting the four faces of a square pyramid onto the hemisphere, such that each of the four triangular sections is defined by a border consisting of a linear equatorial edge which corresponds to a portion of the equator of the ball and two linear side edges connecting each end of the equatorial edge to a pole of the ball. The four triangular sections of each hemisphere are substantially identical in size and dimple arrangement. The dimple arrangement within each of the four triangular sections optionally includes a shared polar dimple having a centroid that lies at the vertex of the two side edges of the section. The dimple arrangement within each of the four triangular sections is not rotationally symmetric about the center of the section. Each of the four triangular sections can be divided into a polar region, an intermediate region, and an equatorial region. The polar region is the area of the triangular section from latitude angle 0° to latitude angle 30°, with latitude angle 0° being the pole. The intermediate region is the area of the triangular section from latitude angle 30° to latitude angle 60°. The equatorial region is the area of the triangular section from latitude angle 60° to latitude angle 90°, with latitude angle 90° being the equator. Optionally, the diameter of the shared polar dimple, if present, is not the minimum dimple diameter or the maximum dimple diameter; alternatively, the diameter of the shared polar dimple, if present, is the minimum dimple diameter.

In a particular embodiment, the polar region includes at least one non-polar dimple having the minimum dimple diameter and does not include a dimple having the maximum dimple diameter. The intermediate region includes at least one dimple having the minimum dimple diameter and at least one dimple having the maximum dimple diameter. The equatorial region includes at least one dimple having the maximum dimple diameter and does not include a dimple having the minimum dimple diameter. In a particular aspect of this embodiment, the intermediate region includes at least one dimple having the minimum dimple diameter. In another particular aspect of this embodiment, the intermediate region includes at least one dimple having the maximum dimple diameter. In another particular aspect of this embodiment, the intermediate region includes at least one dimple having the minimum dimple diameter and at least one dimple having the maximum dimple diameter.

In another particular embodiment, the polar region has a dimple surface coverage $S_p$, the intermediate region has a dimple surface coverage $S_i$, the equatorial region has a dimple surface coverage $S_e$, and $S_p \neq S_i \neq S_e$.

In another particular embodiment, the polar region has a dimple surface coverage $S_p$, the intermediate region has a dimple surface coverage $S_i$, the equatorial region has a dimple surface coverage $S_e$, and $S_i < S_p < S_e$. In a further particular aspect of this embodiment, each of the polar region, the intermediate region, and the equatorial region includes at least one dimple having the maximum dimple diameter. In another further particular aspect of this embodiment, the dimple arrangement includes a shared polar dimple, and the shared polar dimple has the minimum dimple diameter.

In another particular embodiment, the polar region has a dimple surface coverage $S_p$, the intermediate region has a dimple surface coverage $S_i$, the equatorial region has a dimple surface coverage $S_e$, and $S_p < S_i < S_e$. In a further particular aspect of this embodiment, $S_p > 70$. In another further particular aspect of this embodiment, each dimple positioned adjacent to the parting line of the golf ball is intersected by the equator and all of the dimples that are intersected by the equator have the same dimple diameter.

In another particular embodiment, from 2% to 10% of the dimples have an elliptical plan shape. In a particular aspect of this embodiment, each dimple having an elliptical plan shape is located in the polar region.

In another particular embodiment, a majority of the dimples are spherical dimples having a circular plan shape and a cross-sectional profile defined by a spherical function, the difference in the average edge angle of the spherical dimples present in the polar region and the average edge angle of the spherical dimples present in the intermediate region is greater than 0.25°, the difference in the average edge angle of the spherical dimples present in the intermediate region and the average edge angle of the spherical dimples present in the equatorial region is greater than 0.25°, and the difference in the average edge angle of the spherical dimples present in the polar region and the average edge angle of the spherical dimples present in the equatorial region is greater than 0.25°.

In another aspect, a subset or all of the dimples has a catenary cross-sectional profile defined by x-y coordinates, wherein x=0 corresponds to a central axis of the catenary cross-sectional profile and y=0 corresponds to a minimum, bottom, or lowest point of the catenary cross-sectional profile, and the profile is defined by:

$$y = \frac{d_c(\cosh(SF \cdot x) - 1)}{\cosh\left(SF \cdot \frac{D}{2}\right) - 1}$$

where D is a diameter of the dimples having the catenary cross-sectional profile, $d_c$ is a chord depth of the dimples having the catenary cross-sectional profile, and SF is a shape factor of the dimples having the catenary cross-sectional profile.

In one aspect, the shape factor is at least 10. In another aspect, the shape factor is at least 15. In another aspect, the shape factor is at least 20. In another aspect, the shape factor is at least 30. In another aspect, the shape factor is at least 50. In another aspect, the shape factor is 1-200.

In one aspect, a majority of the plurality of dimples on the golf ball have the catenary cross-sectional profile. In one aspect, all of the plurality of dimples on the golf ball have the catenary cross-sectional profile.

In one aspect, the plurality of dimples having the catenary cross-sectional profile each have an identical shape factor. In another aspect, the plurality of dimples having the catenary cross-sectional profile each have an identical chord depth. In one aspect, a subset of dimples among the plurality of dimples have an elliptical plan shape.

In one aspect, the dimples having the elliptical plan shape are in the polar region. In one aspect, the dimples having the elliptical plan shape are only in the polar region. One of ordinary skill in the art would understand that the dimples having the elliptical plan shape can be in at least one of the polar region, equatorial region, or intermediate region. The plurality of the dimples having the elliptical plan shape can each have the catenary cross-sectional profile.

A first subset of the plurality of the dimples can have a first chord depth, and the plurality of dimples having the elliptical plan shape can have a second chord depth that is different than the first chord depth. The second chord depth can be less than the first chord depth. The first chord depth can be greater than the second chord depth.

The plurality of dimples having the elliptical plan shape can have a first shape factor of the catenary cross-sectional profile along a major axis, and a second shape factor of the catenary cross-sectional profile along a minor axis. In one aspect, the first and second shape factors are identical.

In another aspect, the first and second shape factors are different.

In one aspect, a first subset of the plurality of dimples can have a circular plan shape and a second subset of the plurality of dimples can have an elliptical plan shape.

The first subset of the plurality of dimples (i.e., the circular plan shape dimples) can include a first quantity of dimples and the second subset of the plurality of dimples (i.e., the elliptical plan shape dimples) can include a second quantity of dimples. The first quantity can be at least 15 times greater than the second quantity. The first quantity can be at least 300 and the second quantity can be less than 30. The first quantity can be 330 and the second quantity can be 16. In another aspect, the first quantity can be 300-330 and the second quantity can be 1-30. One of ordinary skill in the art would understand that the first and second quantities can vary.

The first subset of the plurality of dimples can include dimples having at least five different diameters and having at least five different edge angles. The second subset of the plurality of dimples can include dimples having at least two different diameters and having at least two different edge angles.

One of ordinary skill in the art would appreciate various other features of the present disclosure, which are described in more detail herein.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION

A square pyramid is a polyhedron formed by connecting each of the four vertices of a square base to an apex. The resulting solid consists of the square base and four triangular faces that are equal in size, and has five vertices, including the four vertices of the square base and the apex. Each of the four triangular faces has two side edges and a base edge. Adjacent faces have a common side edge. Thus, a square pyramid has eight linear edges, including four side edges and four base edges.

A square dipyramid is a polyhedron formed from two square pyramids joined at their bases. The resulting solid consists of eight triangular faces that are equal in size, and has six vertices, including four vertices of the base at which the two square pyramids are joined and the apex of each of the two square pyramids. Each of the eight triangular faces has two side edges and a base edge. Adjacent faces on the same side of the square dipyramid have a common side edge, and adjacent faces on opposite sides of the square dipyramid have a common base edge. Thus, a square dipyramid has twelve linear edges, including eight side edges and four base edges.

Figure 1:
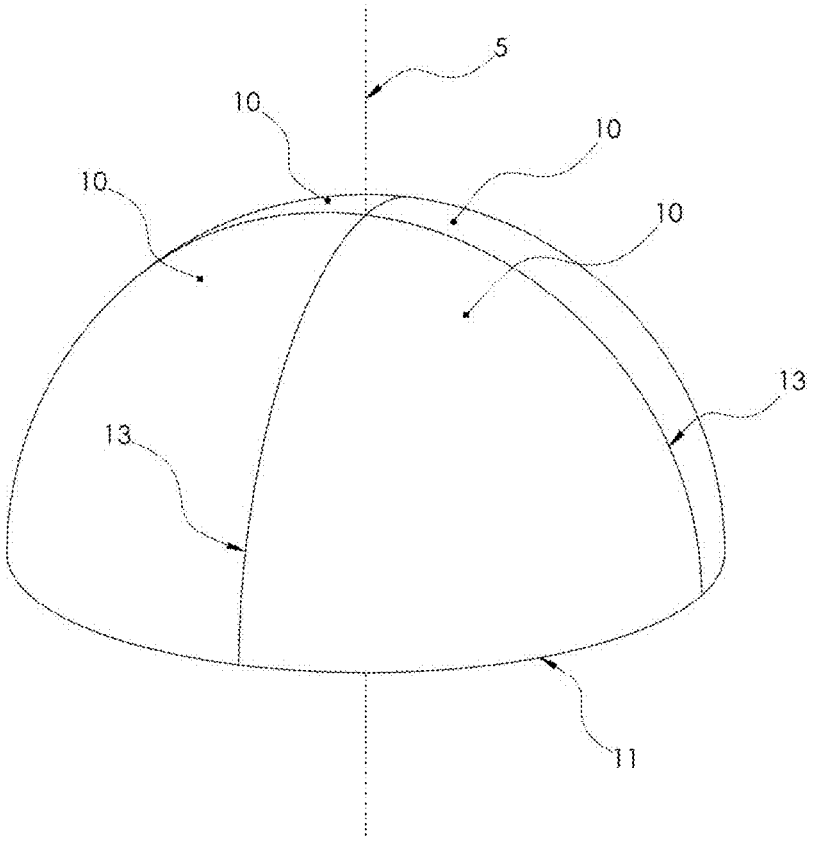
FIG. 1 illustrates four faces of a square pyramid projected onto a hemisphere.

Golf ball dimple patterns of the present invention are based on a square dipyramid. As shown in FIG. 1, each hemisphere of the ball consists of four triangular dimple sections 10 defined by projecting the four faces of a square pyramid onto the hemisphere. Each of the four triangular dimple sections is defined by a border consisting of two linear side edges 13 and a linear equatorial edge 11 corresponding to the side edges and the base edge of a face of the square pyramid. Thus, the two hemispheres of the ball correspond to two square pyramids joined at their bases to form a square dipyramid projected onto the spherical outer surface of a golf ball. Each base edge of the square dipyramid, when projected onto the spherical outer surface of the ball, corresponds to a portion of the equator of the ball. Each of the two apexes of the square dipyramid, when projected onto the spherical outer surface of the ball, corresponds to a pole of the ball.

The two hemispheres of the ball have substantially identical dimple arrangements. For purposes of the present disclosure, dimple arrangements are substantially identical if the relative positions of their dimples' centroids are about the same, as would be understood by one of ordinary skill in the art. The overall dimple pattern on the golf ball may have a rotational offset between the two hemispheres of up to 45°.

The dimple arrangement within each of the four triangular dimple sections on each of the two hemispheres of the ball is substantially identical. For purposes of the present disclosure, the triangular section within which a dimple is located is determined based on the location of the centroid of the dimple. Thus, each dimple on the ball is said to be located in a single dimple section, other than dimples having a centroid that is located along a side edge or an equatorial edge.

Dimples having a centroid that is located along an edge are referred to herein as shared dimples. A shared dimple whose centroid lies on a side edge, but does not lie at one of the two apexes of the dipyramid or at one of the four vertices of the base at which the two square pyramids are joined, is referred to herein as a side edge dimple. Thus, side edge dimples are shared between adjacent sections of one hemisphere that have a common side edge on which the centroid of the side edge dimple lies. A shared dimple whose centroid lies on an equatorial edge, but does not lie at one of the four vertices of the base at which the two square pyramids are joined, is referred to herein as a shared equatorial dimple. Thus, shared equatorial dimples are shared between adjacent sections of different hemispheres that have a common equatorial edge on which the centroid of the shared equatorial dimple lies. A shared dimple whose centroid lies at an apex, i.e., a single point shared by the four sections of one hemisphere and corresponding to the pole, is referred to herein as a polar dimple. Thus, polar dimples are shared between the four sections of the hemisphere containing the pole on which the centroid lies. A shared dimple whose centroid lies at one of the four vertices of the base at which the two square pyramids are joined is referred to herein as a base vertex dimple. Thus, base vertex dimples are shared between four sections, including two adjacent sections of one hemisphere that have common equatorial edges with two adjacent sections of the other hemisphere.

Dimples of the present invention are either a shared dimple or a non-shared dimple. Thus, non-shared dimples of the present invention are dimples having a centroid that is not located along an edge. Non-shared dimples of the present invention include dimples having a perimeter that is not intersected by any edge, referred to herein as non-intersected dimples, and dimples having a perimeter that is intersected by an equatorial edge but not a side edge, referred to herein as non-shared equatorial dimples. Dimple patterns of the present invention do not include non-shared dimples having a perimeter that is intersected by a side edge.

The dimple arrangement within each of the triangular sections comprises a plurality of non-intersected dimples, and, optionally, one or more of the following: a polar dimple, one or more side edge dimples, one or more non-shared equatorial dimples, one or more shared equatorial dimples, or one or more base vertex dimples.

In a particular embodiment of the present invention, the dimple arrangement within each of the triangular sections consists of a plurality of non-intersected dimples, at least one side edge dimple, at least one non-shared equatorial dimple, and, optionally, a polar dimple. In a particular aspect of this embodiment, there are no dimple free great circles on the outer surface of the ball. In other words, in this particular aspect, every great circle on the outer surface of the ball intersects at least one dimple.

In another particular embodiment of the present invention, the dimple arrangement within each of the triangular sections consists of a plurality of non-intersected dimples, at least one non-shared equatorial dimple, and, optionally, a polar dimple. In a particular aspect of this embodiment, the triangular section includes a polar dimple, and there are no dimple free great circles on the outer surface of the ball. In another particular aspect of this embodiment, the triangular section does not include a polar dimple, and the outer surface of the ball has two dimple free great circles defined by the side edges of the triangular sections.

In another particular embodiment of the present invention, the dimple arrangement within each of the triangular sections consists of a plurality of non-intersected dimples, at least one side edge dimple, and, optionally, a polar dimple.

In a particular aspect of this embodiment, the outer surface of the ball has a dimple free great circle corresponding to the equator.

In another particular embodiment of the present invention, the dimple arrangement within each of the triangular sections consists of a plurality of non-intersected dimples. In a particular aspect of this embodiment, the outer surface of the ball has a dimple free great circle corresponding to the equator and two dimple free great circles defined by the side edges of the triangular sections.

Referring again to FIG. 1, the dimple arrangement within each of the four triangular dimple sections 10 is substantially identical, such that the dimple arrangement on each hemisphere of the ball has four-way rotational symmetry about a polar axis 5. Thus, for each non-shared dimple located within a particular triangular dimple section, there is a corresponding non-shared dimple in each of the other three dimple sections of that hemisphere. For dimple patterns of the present invention that include side edge dimples, for each side edge dimple having a centroid located along a particular side edge, there is a corresponding side edge dimple located along each of the other three side edges of that hemisphere. For dimple patterns of the present invention that include shared equatorial dimples, for each shared equatorial dimple having a centroid located along a particular equatorial edge, there is a corresponding shared equatorial dimple located along each of the other three equatorial edges. For dimple patterns of the present invention that include polar dimples, a polar dimple on one hemisphere has a corresponding polar dimple on the other hemisphere. For dimple patterns of the present invention that include base vertex dimples, for each base vertex dimple having a centroid located at a particular vertex of the base at which the two square pyramids are joined, there is a corresponding base vertex dimple located at each of the other three base vertices. For each set of corresponding dimples, the relative positions of the dimple centroids within their respective sections are about the same, and, in a particular embodiment, each of the dimples within that set of corresponding dimples has substantially the same dimple characteristics (e.g., plan shape, cross-sectional shape, diameter, edge angle, etc.).

The dimple arrangement within each of the triangular sections is not rotationally symmetric about the center of the section.

Optionally, the dimple arrangement within each of the triangular sections has mirror symmetry over a plane that intersects the polar axis and the midpoint of the linear equatorial edge of the section. In a particular embodiment, the dimple arrangement within each of the triangular sections has mirror symmetry and the centroid of at least one non-polar dimple lies on the plane of mirror symmetry. In a particular aspect of this embodiment, each non-polar dimple whose centroid lies on the plane of minor symmetry has a diameter independently selected from the maximum dimple diameter and the second largest dimple diameter (i.e., the greatest diameter of all of the additional diameters present in the dimple pattern). In another particular aspect of this embodiment, each non-polar dimple whose centroid lies on the plane of mirror symmetry has the maximum dimple diameter.

Figure 2:
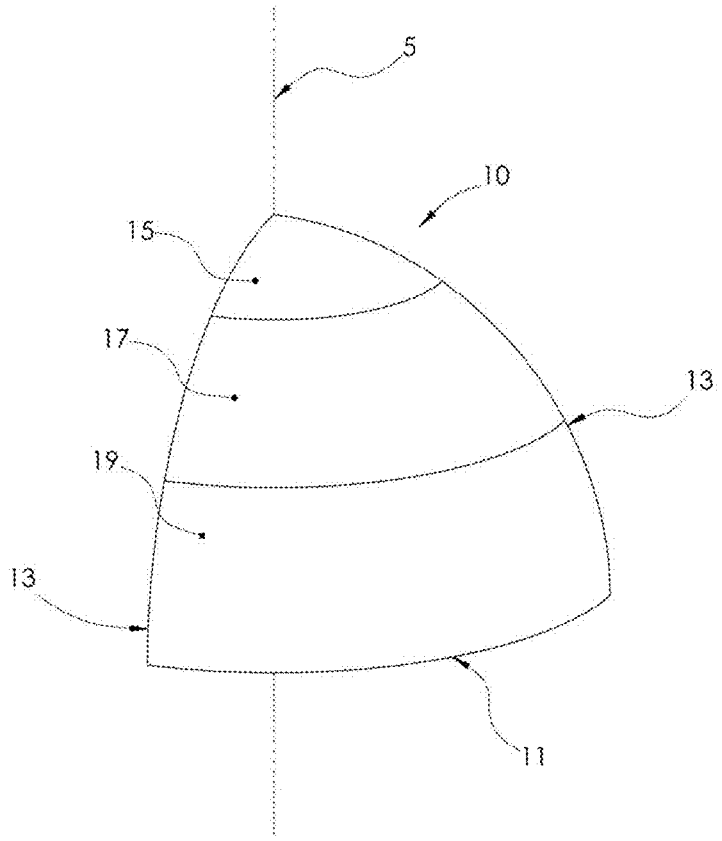
FIG. 2 illustrates one of the four faces of FIG. 1 divided into three regions.

Each of the triangular sections can be divided into three regions: a polar region, an intermediate region, and an equatorial region. The polar region is the area of the triangular section from latitude angle 0° to latitude angle 30°. The intermediate region is the area of the triangular section from latitude angle 30° to latitude angle 60°. The equatorial region is the area of the triangular section from latitude angle 60° to latitude angle 90°. Latitude angle 0° is the pole. Latitude angle 90° is the equator. For example, FIG. 2 shows one of the triangular dimple sections 10 of FIG. 1. The triangular section is divided into a polar region 15, an intermediate region 17, and an equatorial region 19.

The region within which a dimple is located is determined based on the location of the centroid of the dimple. For purposes of the present disclosure, a dimple having a centroid located at a latitude angle of less than 28° is defined as being within the polar region; a dimple having a centroid located at a latitude angle of from 28° to 32° is defined as being shared between the polar region and the intermediate region; a dimple having a centroid located at a latitude angle that is greater than 32° and less than 58° is defined as being within the intermediate region; a dimple having a centroid located at a latitude angle that is from 58° to 62° is defined as being shared between the intermediate region and the equatorial region; and a dimple having a centroid located at a latitude angle that is greater than 62° is defined as being within the equatorial region.

As discussed further below, for purposes of calculating the dimple surface coverage of a region, for dimples that are defined as being within either the polar region or the intermediate region or the equatorial region (i.e., dimples that are not defined as being shared between two regions), the entire area of the plan shape of the dimple is included in the calculation of the dimple surface coverage of the region in which the centroid of the dimple is located, even though a portion of the dimple may lie in another region. For dimples that are defined as being shared between either the polar and intermediate regions or the intermediate and equatorial regions, exactly one half of the entire area of the plan shape of the dimple is included in the calculation of the dimple surface coverage for each region sharing that dimple.

It should also be noted that, in embodiments of the present invention wherein the dimple pattern includes side edge dimples, when calculating the dimple surface coverage for the polar, intermediate, and equatorial regions of a single triangular section, only half of the total plan shape area for each side edge dimple is included in the calculation.

The polar region of each triangular section has a dimple surface coverage $S_p$, which, for purposes of the present invention, is determined as follows. The surface area of the polar region of each triangular section (if no dimples were present), $A_p$, is calculated as:

$$A_p = \frac{2\pi R \cdot h_p}{4},$$

where R is the ball radius $$\left(\text{i.e., } R = \frac{\text{Ball Diameter}}{2}\right), \text{ and } h_p = R\left(1 - \cos\left(\frac{\pi}{6}\right)\right).$$

The sum of the plan shape areas of all of the dimples located in (i.e., having centroids located in) the polar region of each triangular section, $AD_p$, is calculated. The dimple surface coverage of the polar region of each triangular section, $S_p$, is then calculated as:

$$S_p = \frac{AD_p}{A_p} \times 100.$$

The intermediate region of each triangular section has a dimple surface coverage $S_i$, which, for purposes of the present invention, is determined as follows. The surface area of the intermediate region of each triangular section (if no dimples were present), $A_i$, is calculated as:

$$A_i = \frac{2\pi R \cdot h_i}{4} - A_p,$$

where R is the ball radius $$\left(\text{i.e., } R = \frac{\text{Ball Diameter}}{2}\right),\ h_i = R\left(1 - \cos\left(\frac{\pi}{3}\right)\right),$$

and $A_p$ is the surface area of the polar region of each triangular section (if no dimples were present), calculated according to the equation above. The sum of the plan shape areas of all of the dimples located in (i.e., having centroids located in) the intermediate region of each triangular section, $AD_i$, is calculated. The dimple surface coverage of the intermediate region of each triangular section, $S_i$, is then calculated as:

$$S_i = \frac{AD_i}{A_i} \times 100.$$

The equatorial region of each triangular section has a dimple surface coverage $S_e$, which, for purposes of the present invention, is determined as follows. The surface area of the equatorial region of each triangular section (if no dimples were present), $A_e$, is calculated as:

$$A_e = \frac{2\pi R \cdot h_e}{4} - A_p - A_i,$$

where R is the ball radius $$\left(\text{i.e., } R = \frac{\text{Ball Diameter}}{2}\right),\ h_e = R\left(1 - \cos\left(\frac{\pi}{2}\right)\right),$$

and $A_p$ and $A_i$ are the surface area of the polar region of each triangular section (if no dimples were present) and the surface area of the intermediate region of each triangular section (if no dimples were present), respectively, calculated according to the equations above. The sum of the plan shape areas of all of the dimples located in (i.e., having centroids located in) the equatorial region of each triangular section, $AD_e$, is calculated. The dimple surface coverage of the equatorial region of each triangular section, $S_e$, is then calculated as:

$$S_e = \frac{AD_e}{A_e} \times 100.$$

In a particular embodiment, dimple patterns of the present invention have one or more of the following properties:

a) $S_p \neq S_i \neq S_e$;
b) $S_p < S_i < S_e$;
c) $S_i - S_p \geq 1$ or $\geq 4$ or $\geq 5$ or $\geq 7$;
d) $S_e - S_i \geq 1$ or $\geq 4$ or $\geq 5$ or $\geq 7$;
e) $S_e - S_p \geq 5$ or $\geq 7$ or $\geq 8$ or $\geq 11$;
f) $S_p > 70$; and
g) $S_e \geq 80$.

In another particular embodiment, dimple patterns of the present invention have one or more of the following properties:

a) $S_i < S_p < S_e$;
b) $S_i \geq 70$;
c) $S_i \geq 75$; and
d) $S_i \geq 80$.

Each triangular section includes at least three different dimple diameters, including a maximum dimple diameter, a minimum dimple diameter, and at least one additional dimple diameter. In a particular embodiment, each triangular section includes at least four different dimple diameters. In another particular embodiment, each triangular section includes at least five different dimple diameters. In another particular embodiment, each triangular section includes at least six different dimple diameters. In a particular aspect of embodiments of the present invention wherein a polar dimple is present, the polar dimple does not have the minimum dimple diameter. In another particular aspect of embodiments of the present invention wherein a polar dimple is present, the polar dimple has the minimum dimple diameter. It should be understood that manufacturing variances are to be taken into account when determining the number of different dimple diameters. For purposes of the present disclosure, dimples having substantially the same diameter, also referred to herein as "same diameter" dimples, includes dimples on a finished ball having respective diameters that differ by less than 0.005 inches due to manufacturing variances.

In a particular embodiment, dimple patterns of the present invention have one or more of the following properties:

a) the polar region of each triangular section includes at least one dimple that has the minimum dimple diameter and is not a polar dimple, and, optionally, the latitude angle of at least one non-polar dimple located in the polar region and having the minimum dimple diameter is less than 20°;
b) the polar region of each triangular section does not include a dimple having the maximum dimple diameter;
c) the equatorial region of each triangular section includes at least one dimple having the maximum dimple diameter;
d) the equatorial region of each triangular section does not include a dimple having the minimum dimple diameter;
e) the intermediate region of each triangular section includes at least one dimple having the minimum dimple diameter; and
f) the intermediate region of each triangular section includes at least one dimple having the maximum dimple diameter.

In another particular embodiment, dimple patterns of the present invention have one or more of the following properties:

a) the polar region of each triangular section includes at least one dimple having the maximum dimple diameter;
b) the intermediate region of each triangular section includes at least one dimple having the maximum dimple diameter;
c) the equatorial region of each triangular section includes at least one dimple having the maximum dimple diameter;

d) the polar region includes at least one dimple having the minimum dimple diameter, at least one dimple having the maximum dimple diameter, at least one dimple having a first additional diameter, at least one dimple having a second additional diameter, and, optionally, at least one dimple having a third additional diameter; and e) each triangular section includes a plurality of side edge dimples, and each of the plurality of side edge dimples has a diameter independently selected from the maximum dimple diameter and the greatest diameter of all of the additional dimple diameters present on the ball.

In another particular embodiment, dimple patterns of the present invention have one or more of the following properties:

a) the polar region of each triangular section includes at least one dimple that has the minimum dimple diameter and is not a polar dimple, and, optionally, the latitude angle of at least one non-polar dimple located in the polar region and having the minimum dimple diameter is less than 20°;

b) the intermediate region of each triangular section includes at least one dimple having the minimum dimple diameter;

c) the equatorial region of each triangular section does not include a dimple having the minimum dimple diameter;

d) the polar region of each triangular section does not include a dimple having the maximum dimple diameter;

e) the intermediate region of each triangular section includes at least one dimple having the maximum dimple diameter;

f) the equatorial region of each triangular section includes at least one dimple having the maximum dimple diameter;

g) each triangular section includes a plurality of side edge dimples, and the plurality of side edge dimples includes at least three different dimple diameters; and h) each dimple positioned adjacent to the parting line of the golf ball is intersected by the equator and all of the dimples that are intersected by the equator have the same dimple diameter, and, optionally all of the dimples that are intersected by the equator have the maximum dimple diameter.

Dimple patterns of the present invention optionally have one or more of the following additional properties:

a) the overall surface coverage of the golf ball is 75% or greater, or 78% or greater, or 80% or greater;

b) there is a polar dimple;

c) there is no polar dimple;

d) each triangular section includes at least four, or at least five, different dimple diameters;

e) within each triangular section, the number of different dimple diameters located in the intermediate region is greater than the number of different dimple diameters located in the polar region and greater than the number of different dimple diameters located in the equatorial region;

f) within each triangular section, the number of different dimple diameters located in the polar region is equal to the number of different dimple diameters located in the equatorial region, or the number of different dimple diameters located in the polar region is greater than the number of different dimple diameters located in the equatorial region;

g) the polar region includes at least four different dimple diameters;

h) the intermediate region includes at least five different dimple diameters;

i) the equatorial region includes at least three different dimple diameters;

j) the total number of dimples having the minimum dimple diameter is greater than the number of dimples having the maximum dimple diameter;

k) the total number of dimples having the minimum dimple diameter is less than the number of dimples having the maximum dimple diameter;

l) there are no dimple free great circles on the outer surface of the ball;

m) the outer surface of the ball has a dimple free great circle corresponding to the equator; and n) the outer surface of the ball has a dimple free great circle corresponding to the equator and two dimple free great circles defined by the side edges of the triangular sections.

In another aspect, the present invention provides a golf ball having a plurality of dimples disposed on the spherical outer surface thereof. In one aspect, the golf ball has a non-planar parting line. The plurality of dimples can comprise at least three different dimple diameters, including a minimum dimple diameter, a maximum dimple diameter, and at least one additional dimple diameter. The golf ball can consist of two hemispheres separated by an equator, the two hemispheres having substantially identical dimple arrangements. Each hemispherical dimple arrangement can consist of four triangular sections that are defined by projecting the four faces of a square pyramid onto the hemisphere such that each of the four triangular sections is defined by a border consisting of a linear equatorial edge which corresponds to a portion of the equator of the golf ball and two linear side edges connecting each end of the equatorial edge to a pole of the golf ball. The four triangular sections of each hemisphere can be substantially identical in size and dimple arrangement. The dimple arrangement within each of the four triangular sections can be not rotationally symmetric (i.e., rotationally asymmetric) about a center of the respective triangular section. Each of the four triangular sections can be divided into a polar region from latitude angle 0° to latitude angle 30°, an intermediate region from latitude angle 30° to latitude angle 60°, and an equatorial region from latitude angle 60° to latitude angle 90°, where latitude angle 0° is the pole and latitude angle 90° is the equator. The polar region can have a dimple surface coverage $S_p$, the intermediate region can have a dimple surface coverage $S_i$, and the equatorial region has a dimple surface coverage $S_e$, such that $S_p<S_i<S_e$; and $S_p \geq 70.0\%$.

In one aspect, surface coverage percentages can be calculated using the planar coverage areas of the dimples. For the circular dimples, the dimple surface area (A) can be defined as $A=(\pi d^2)/4$.

For the elliptical dimples, the dimple surface area (A) can be defined as $A=(\pi d_{max} d_{min})/4$, where $d_{max}$ is the maximum diameter across the ellipse (i.e., the major axis) and $d_{min}$ is the minimum diameter across the ellipse (i.e., the minor axis).

A subset or all of the plurality of dimples can have a profile defined by x-y coordinates, wherein x=0 corresponds to a central axis of the catenary cross-sectional profile and y=0 corresponds to a minimum or bottom of the catenary cross-sectional profile, and the catenary cross-sectional profile is defined by:

$$y = \frac{d_c(\cosh(SF \cdot x) - 1)}{\cosh\left(SF \cdot \frac{D}{2}\right) - 1}$$

where D is a diameter of the dimples having the catenary cross-sectional profile, $d_c$ is a chord depth of the dimples having the catenary cross-sectional profile, and SF is a shape factor of the dimples having the catenary cross-sectional profile. The shape factor can be at least 20, in one example, but can vary as one of ordinary skill in the art would appreciate based on this disclosure.

Dimple patterns of the present invention optionally have one or more of the following additional properties:

a. a majority of the dimples have the catenary cross-sectional profile;

b. all of the dimples have the catenary cross-sectional profile;

c. the dimples having the catenary cross-sectional profile each have an identical shape factor SF;

d. the dimples having the catenary cross-sectional profile each have an identical chord depth $d_c$;

e. a subset of dimples have an elliptical plan shape;

f. the dimples having the elliptical plan shape are only in the polar region;

g. the dimples having the elliptical plan shape each have the catenary cross-sectional profile;

h. a first subset of the dimples have a first chord depth, and the dimples having the elliptical plan shape have a second chord depth that is different than the first chord depth, and the second chord depth is less than the first chord depth or the first chord depth is greater than the second chord depth;

i. the dimples having the elliptical plan shape have a first shape factor of the catenary cross-sectional profile along a major axis, and a second shape factor of the catenary cross-sectional profile along a minor axis, and the first and second shape factors are identical;

j. the dimples having the elliptical plan shape have a first shape factor of the catenary cross-sectional profile along a major axis, and a second shape factor of the catenary cross-sectional profile along a minor axis, and the first and second shape factors are different;

k. a first subset of the dimples has a circular plan shape and a second subset the dimples has an elliptical plan shape;

l. the first subset of the dimples includes a first quantity of dimples and the second subset of the dimples includes a second quantity of dimples, wherein the first quantity is at least 15 times greater than the second quantity;

m. the first subset of the dimples includes a first quantity of dimples and the second subset of the dimples includes a second quantity of dimples, wherein the first quantity is at least 15 times greater than the second quantity, and the first quantity is at least 300 and the second quantity is less than 30;

n. the first subset of the dimples includes a first quantity of dimples and the second subset of the dimples includes a second quantity of dimples, wherein the first quantity is at least 15 times greater than the second quantity, and the first quantity is 330 and the second quantity is 16;

o. a standard deviation of edge angles among all of the dimples of the first subset of the dimples and all of the dimples of the second subset of the dimples is at least 0.50°; and p. a standard deviation of chord depths among all of the dimples of the first subset of the dimples and all of the dimples of the second subset of the dimples is no greater than 0.00020 inches.

The shape factor (SF) can be an independent variable in the mathematical function that defines a catenary dimple cross-sectional shape, as further disclosed in, for example, U.S. Pat. Nos. 6,796,912, 7,163,472, 7,491,137, 7,887,439, and 9,782,628, which are each commonly assigned to Acushnet Company, and which are each hereby incorporated by reference in their entirety as if fully set forth herein.

Dimples of the present invention are not limited to a particular plan shape or profile shape. Particularly suitable plan shapes include, but are not limited to, circular, polygonal, oval, and irregular shapes. Particularly suitable profile shapes include, but are not limited to, circular, catenary, elliptical, and conical shapes.

In a particular embodiment, dimple patterns of the present invention include a plurality of dimples having an elliptical plan shape. Elliptical plan shapes have a major axis and a minor axis, the length of the major axis being greater than the length of the minor axis. The length of the minor axis of elliptical plan shapes of dimples of the present invention is preferably, but not necessarily, from 0.120 inches to 0.160 inches. The difference between the length of the major axis and the length of the minor axis of elliptical plan shapes of dimples of the present invention is preferably, but not necessarily, 0.020 inches or less, or the difference is 0.003 inches or 0.005 inches or 0.020 inches, or the difference is within a range having a lower limit and an upper limit selected from these values. The difference between the length of the major axis and the length of the minor axis of an elliptical plan shape of one dimple may be the same as or different than that of an elliptical plan shape of another dimple. For example, the dimples having an elliptical plan shape may include a first portion of dimples wherein the difference between the length of the major axis and the length of the minor axis is from 0.003 inches to 0.005 inches, and a second portion of dimples wherein the difference between the length of the major axis and the length of the minor axis is from 0.005 inches to 0.020 inches. The ratio of the length of the major axis to the length of the minor axis of elliptical plan shapes of dimples of the present invention is preferably, but not necessarily, from 1.02 to 1.10, or from 1.02 to 1.04, or from 1.04 to 1.10. The ratio of the length of the major axis to the length of the minor axis of an elliptical plan shape of one dimple may be the same as or different than that of an elliptical plan shape of another dimple. For example, the dimples having an elliptical plan shape may include a first portion of dimples wherein the ratio of the length of the major axis to the length of the minor axis is from 1.02 to 1.04, and a second portion of dimples wherein the ratio of the length of the major axis to the length of the minor axis is from 1.04 to 1.10.

In a particular aspect of this embodiment, at least 2%, or from 2% to 10%, or from 4% to 8%, of the dimples have an elliptical plan shape. In a further particular aspect of this embodiment, the remaining dimples consist of dimples having a circular plan shape. In another further particular aspect of this embodiment, the remaining dimples consist of dimples having a non-elliptical, non-circular plan shape. In another further particular aspect of this embodiment, the remaining dimples include a first portion of dimples having a circular plan shape and a second portion of dimples having a non-elliptical, non-circular plan shape.

In another particular aspect of this embodiment, each dimple having an elliptical plan shape is located in the polar region. In a further particular aspect of this embodiment, the polar dimple, if present, has a circular plan shape.

Figure 3:
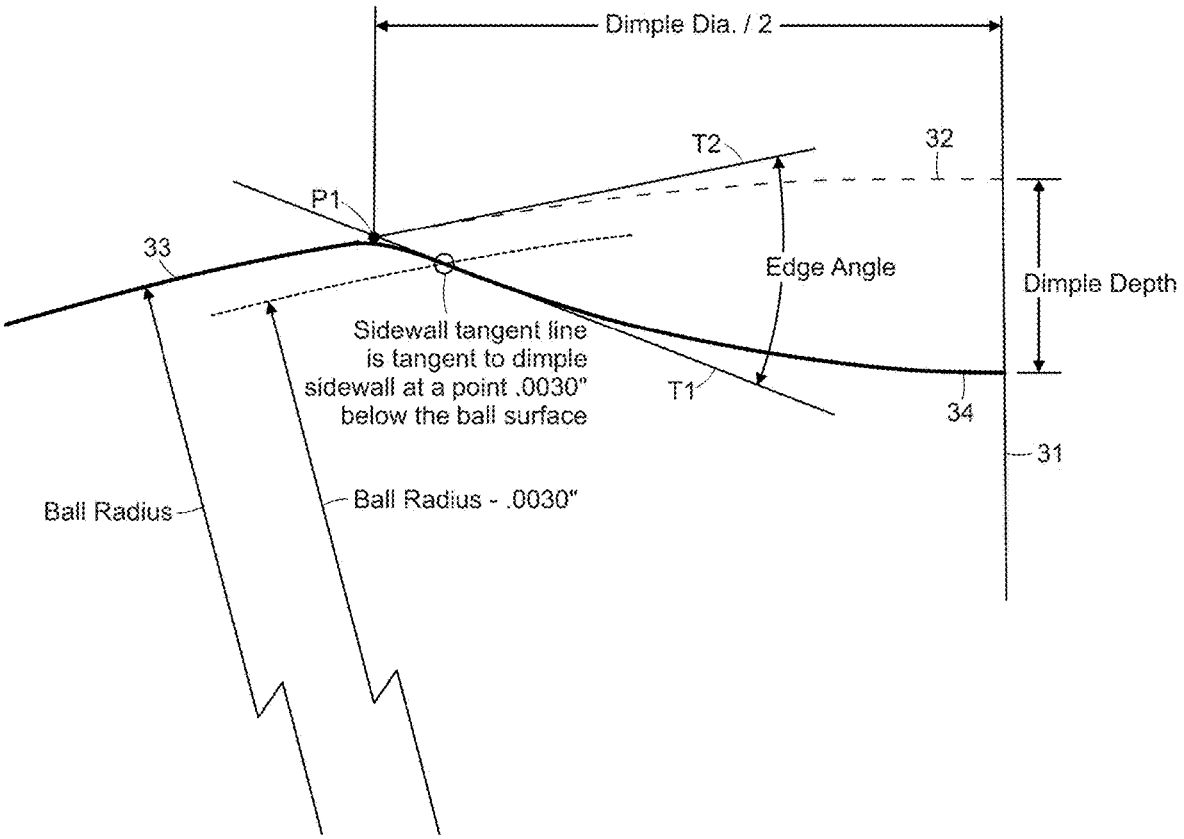
FIG. 3 is a schematic diagram illustrating a method for measuring the diameter of a dimple.

Each dimple on the outer surface of the ball preferably has a diameter of 0.050 or 0.060 or 0.070 or 0.080 or 0.090 or 0.100 or 0.110 or 0.120 or 0.130 or 0.150 or 0.160 or 0.170 or 0.180 or 0.190 or 0.200 or 0.205 or 0.210 or 0.220 or 0.250 inches or a diameter within a range having a lower limit and an upper limit selected from these values. In a particular embodiment, the maximum difference between any two dimple diameters on the ball is less than 0.055 inches. The diameter of a dimple having a non-circular plan shape is defined by its equivalent diameter, $d_e$, which calculated as:

$$d_e = 2\sqrt{\frac{A}{\pi}}$$

where A is the plan shape area of the dimple. By the term, "plan shape area," it is meant the area based on a planar view of the dimple plan shape, such that the viewing plane is normal to an axis connecting the center of the golf ball to the centroid of the dimple. Diameter measurements are determined on finished golf balls according to FIG. 3. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous. To resolve this problem, dimple diameter on a finished golf ball is measured according to the method shown in FIG. 3. FIG. 3 shows a dimple half-profile 34, extending from the dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter is the distance between P1 and its equivalent point diametrically opposite along the dimple perimeter. Alternatively, it is twice the distance between P1 and the dimple centerline 31, measured in a direction perpendicular to centerline 31. The dimple depth is the distance measured along a ball radius from the phantom surface of the ball to the deepest point on the dimple. The dimple volume is the space enclosed between the phantom surface 32 and the dimple surface 34 (extended along T1 until it intersects the phantom surface).

In a particular embodiment, a majority of the dimples on the outer surface of golf balls of the present invention are spherical dimples, i.e., dimples having a circular plan shape and a profile shape based on a spherical function.

In a particular aspect of this embodiment, the spherical dimples have one or more properties/characteristics selected from:

a) the edge angle of each spherical dimple is 10° or 11° or 12° or 13° or 14° or 15° or 16°, or is within a range having a lower limit and an upper limit selected from these values;

b) the maximum difference in edge angle between any two of the spherical dimples is 1°; and c) the edge angle of all of the spherical dimples is substantially the same (For purposes of the present disclosure, edge angles on a finished ball are substantially the same if they differ by less than 0.25°.).

In another particular aspect of this embodiment, the spherical dimples have one or more properties/characteristics selected from:

a) the edge angle of each spherical dimple is 10° or 11° or 12° or 13° or 14° or 15° or 16°, or is within a range having a lower limit and an upper limit selected from these values;

b) the difference in the average edge angle of the spherical dimples present in the polar region and the average edge angle of the spherical dimples present in the intermediate region is greater than 0.25°, or greater than 0.50°;

c) the difference in the average edge angle of the spherical dimples present in the intermediate region and the average edge angle of the spherical dimples present in the equatorial region is greater than 0.25°, or greater than 0.50°;

d) the difference in the average edge angle of the spherical dimples present in the polar region and the average edge angle of the spherical dimples present in the equatorial region is greater than 0.25°, or greater than 0.50°;

e) the average edge angle of the spherical dimples present in the polar region is less than the average edge angle of the spherical dimples present in the intermediate region;

f) the average edge angle of the spherical dimples present in the intermediate region is less than the average edge angle of the spherical dimples present in the equatorial region;

g) the average edge angle of the spherical dimples present in the polar region is greater than the average edge angle of the spherical dimples present in the intermediate region;

h) the average edge angle of the spherical dimples present in the intermediate region is greater than the average edge angle of the spherical dimples present in the equatorial region;

i) the spherical dimples present in the polar region have substantially the same edge angle;

j) the spherical dimples present in the intermediate region have substantially the same edge angle;

k) the spherical dimples present in the equatorial region have substantially the same edge angle;

l) the spherical dimples present in the polar region include dimples having at least two different edge angles;

m) the spherical dimples present in the intermediate region include dimples having at least two different edge angles; and n) the spherical dimples present in the equatorial region include dimples having at least two different edge angles.

Preferably, none of the dimples on the outer surface of the ball overlap or touch.

Dimple patterns generated by the present invention are capable of achieving a high percentage of surface coverage. In a particular embodiment, the present invention generates a surface coverage of about 75% or greater. In another particular embodiment, the present invention generates a surface coverage of about 78% or greater.

The total number of dimples on the golf ball is preferably an even number between about 250 and about 500. In a particular embodiment, the total number of dimples is 320 or 322 or 328 or 330 or 336 or 338 or 344 or 346 or 352 or 354 or 360 or 362 or 368 or 370 or the total number of dimples is within a range having a lower limit and an upper limit selected from these values.

Golf balls of the present invention are not limited by a particular golf ball construction. The golf ball may have any type of core, such as solid, liquid, wound, and the like, and may be a one-piece, two-piece, or multilayer ball. Each layer of the golf ball may be constructed from any suitable thermoset or thermoplastic material known to those of ordinary skill in the art. When desirable, the cover may be coated with any number of layers, such as a base coat, top coat, paint, or any other desired coating. As will be appreciated by those skilled in the art, any manufacturing technique may be used to construct the various portions of the golf ball. In a particular embodiment, the golf ball is a multilayer ball comprising a solid, single layer core, an inner cover layer, and an outer cover layer. In a particular aspect of this embodiment, the core is formed from a thermoset rubber, the inner cover layer is formed from an ionomer composition, and the outer cover layer is formed from a polyurethane composition.

EXAMPLES

The following non-limiting examples demonstrate dimple patterns of golf balls made in accordance with the present invention. The examples are merely illustrative of the preferred embodiments of the present invention, and are not to be construed as limiting the invention, the scope of which is defined by the appended claims.

Non-Limiting Exemplary Dimple Pattern 1

Figure 4A:
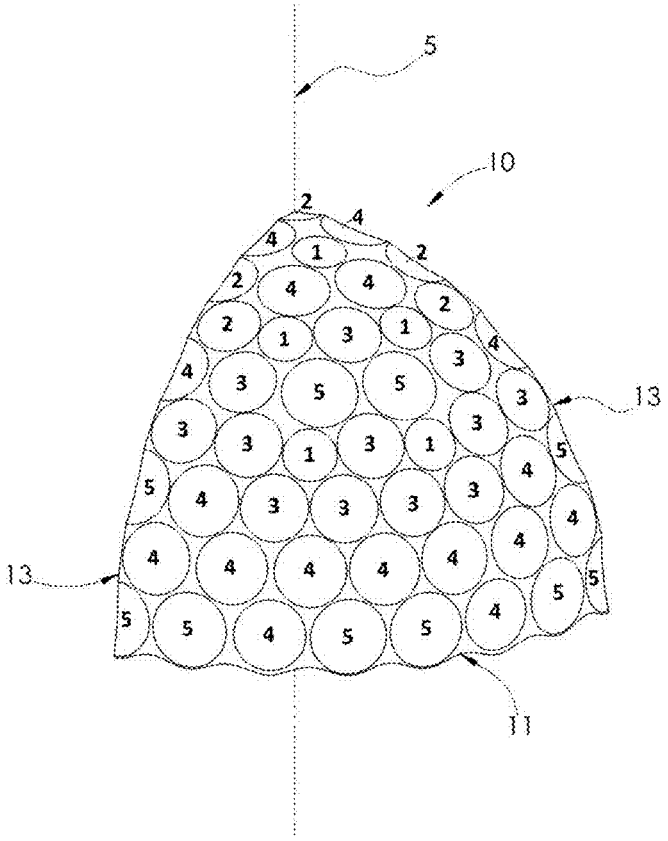
FIGS. 4A-4C illustrate the face of FIG. 2 with dimples arranged therein according to an embodiment of the present invention.
Figure 4B:
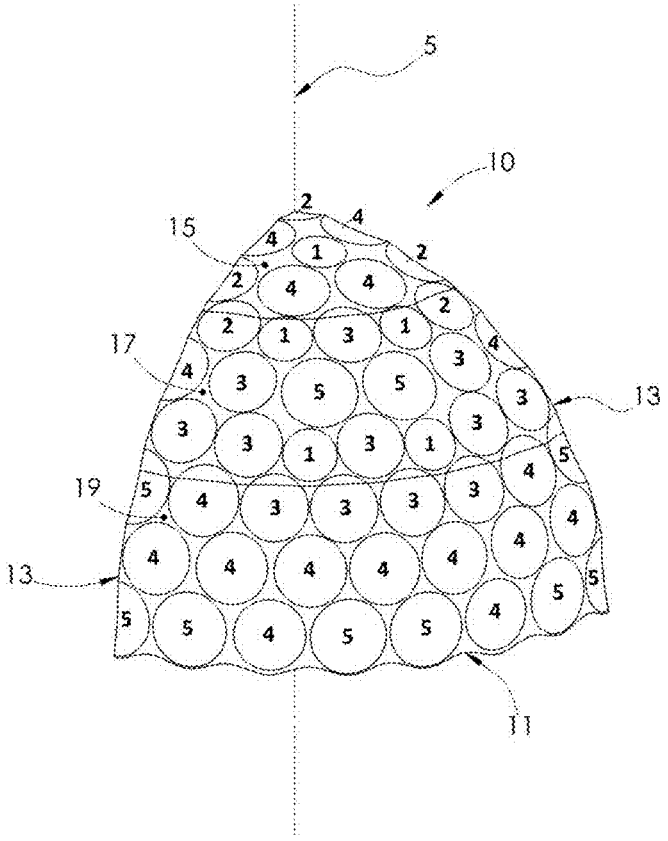
Figure 4C:
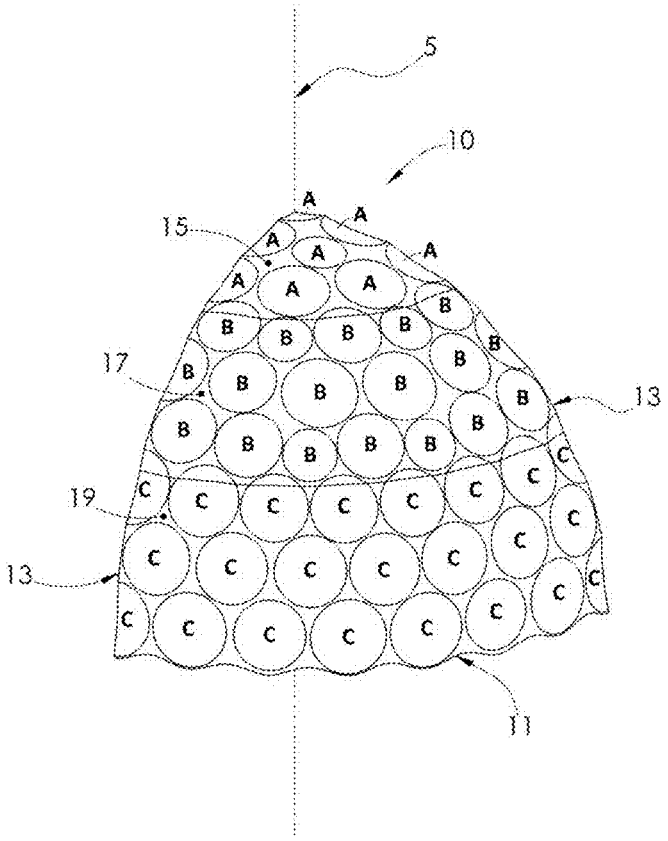

A triangular section of a dimple pattern based on a square dipyramid according to a particular embodiment of the present invention is illustrated in FIGS. 4A-4C. FIGS. 4A-4C show a triangular dimple section 10 packed with dimples into a dimple arrangement consisting of: thirty-two non-intersecting dimples, one polar dimple, ten side edge dimples, and six non-shared equatorial dimples. Thus, a golf ball having a dimple pattern based on a square dipyramid, with each triangular dimple section having the dimple arrangement shown in FIGS. 4A-4C, has a total of 346 dimples, with a surface coverage of about 82.1%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 4A-4B, the numerical labels within the dimples designate same diameter dimples; i.e., all dimples labelled 1 have substantially the same diameter, all dimples labelled 2 have substantially the same diameter, and so on. In a particular aspect of the embodiment illustrated in FIGS. 4A-4C, same diameter dimples also have substantially the same chord depth and substantially the same edge angle. In a further particular aspect of the embodiment illustrated in FIGS. 4A-4C, the dimples labelled 1-5 have the diameters given in Table 1 below:

TABLE 1

| Numerical Label | Dimple Diameter (inches) |
|---|---|
| 1 | 0.128 |
| 2 | 0.150 |
| 3 | 0.160 |
| 4 | 0.170 |
| 5 | 0.180 |

Thus, according to the embodiment shown in FIGS. 4A-4B, and wherein the dimples have properties according to Table 1, the dimples have a total of five different dimple diameters, including a minimum dimple diameter of 0.128 inches and a maximum dimple diameter of 0.180. The total number of dimples on the ball having the minimum dimple diameter is forty, and the total number of dimples on the ball having the maximum dimple diameter is sixty-four.

FIGS. 4B & 4C show lines drawn at latitude angle 30° and latitude angle 60°, thereby dividing the triangular dimple section 10 into a polar region 15, an intermediate region 17, and an equatorial region 19. In FIG. 4C, the alphabetical labels within the dimples designate the region in which the dimple is located; i.e., all dimples labelled A are located in the polar region 15, all dimples labelled B are located in the intermediate region 17, and all dimples labelled C are located in the equatorial region 19.

Thus, according to the embodiment shown in FIGS. 4A-4C, and wherein the dimples have properties according to Table 1, the triangular dimple section 10 has the following properties:

a) the polar region 15 includes one dimple that has the minimum dimple diameter, the latitude angle of which is about 15°;

b) the polar region 15 does not include a dimple having the maximum dimple diameter;

c) the intermediate region 17 includes four dimples having the minimum dimple diameter;

d) the intermediate region 17 includes two dimples having the maximum dimple diameter;

e) the equatorial region 19 includes eight dimples having the maximum dimple diameter, including four non-shared equatorial dimples and four side edge dimples;

f) the equatorial region 19 does not include a dimple having the minimum dimple diameter;

g) the intermediate region 17 includes five different dimple diameters, the polar region 15 includes three different diameters, and the equatorial region 19 includes three different diameters; thus, the number of different dimple diameters located in the intermediate region 17 is greater than the number of different dimple diameters located in the polar region 15 and greater than the number of different dimple diameters located in the equatorial region 19, and the number of different dimple diameters located in the polar region 15 is equal to the number of different dimple diameters located in the equatorial region 19; and h) the polar region 15 has a surface coverage $S_p$ of 69.4%;

i) the intermediate region 17 has a surface coverage $S_i$ of 79.2%; and j) the equatorial region 19 has a surface coverage $S_e$ 87.1%.

Non-limiting Exemplary Dimple Pattern 2

Figure 5A:
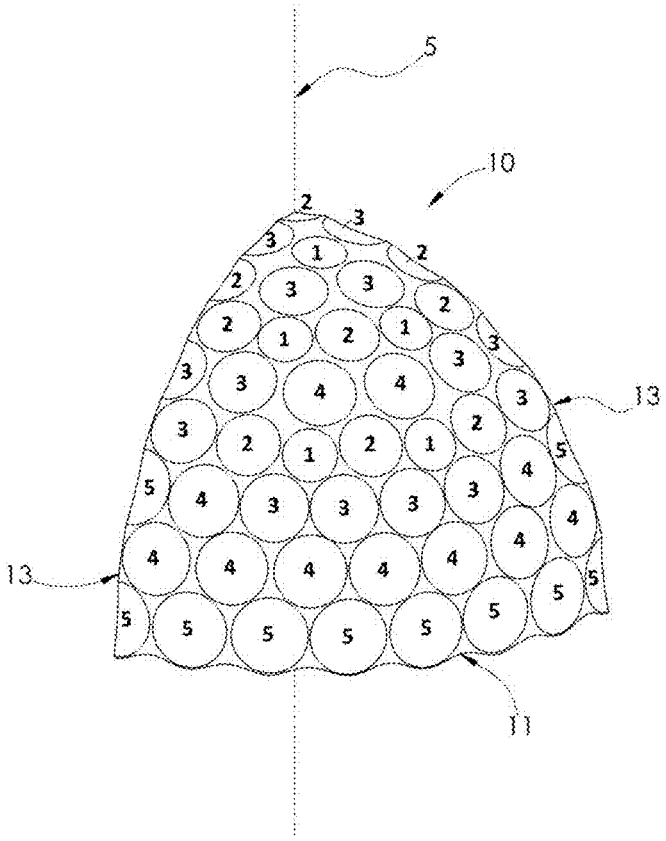
FIGS. 5A-5C illustrate the face of FIG. 2 with dimples arranged therein according to an embodiment of the present invention.
Figure 5B:
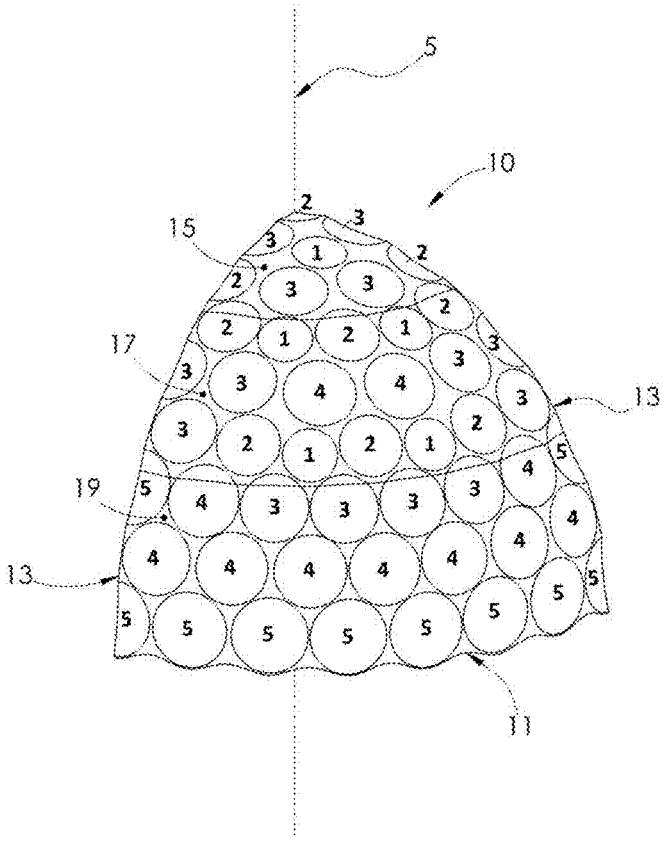
Figure 5C:
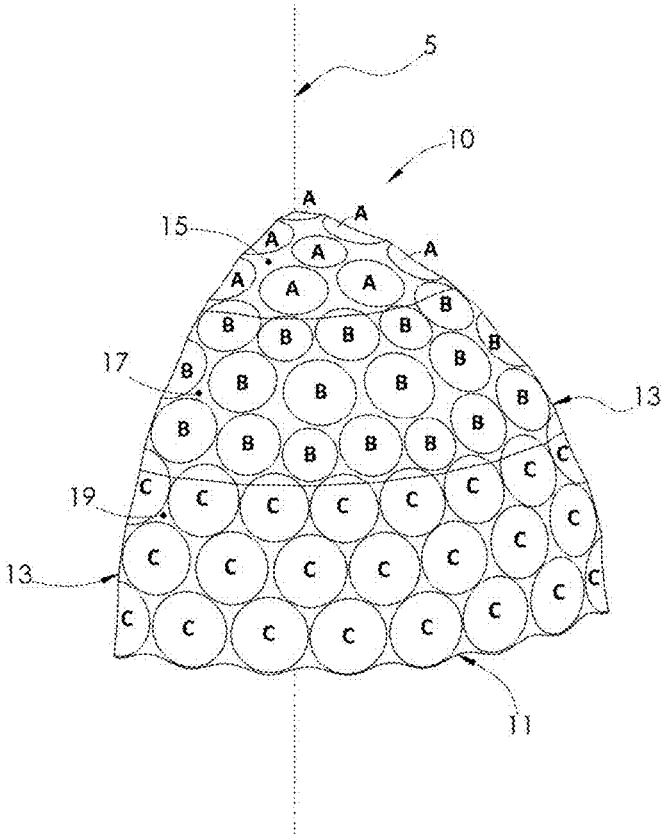

A triangular section of a dimple pattern based on a square dipyramid according to a particular embodiment of the present invention is illustrated in FIGS. 5A-5C. FIGS. 5A-5C show a triangular dimple section 10 packed with dimples into a dimple arrangement consisting of: thirty-two non-intersecting dimples, one polar dimple, ten side edge dimples, and six non-shared equatorial dimples. Thus, a golf ball having a dimple pattern based on a square dipyramid, with each triangular dimple section having the dimple arrangement shown in FIGS. 5A-5C, has a total of 346 dimples, with a surface coverage of about 80.3%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 5A-5B, the numerical labels within the dimples designate same diameter dimples; i.e., all dimples labelled 1 have substantially the same diameter, all dimples labelled 2 have substantially the same diameter, and so on.

In a particular aspect of the embodiment illustrated in FIGS. 5A-5C, same diameter dimples also have substantially the same chord depth and substantially the same edge angle.

In a further particular aspect of the embodiment illustrated in FIGS. 5A-5C, the dimples labelled 1-5 have the diameters given in Table 2 below, all of the dimples having substantially the same chord depth and substantially the same edge angle.

TABLE 2

| Numerical Label | Dimple Diameter (inches) |
|---|---|
| 1 | 0.128 |
| 2 | 0.150 |
| 3 | 0.160 |
| 4 | 0.170 |
| 5 | 0.180 |

In an alternative particular aspect of the embodiment illustrated in FIGS. 5A-5C, same diameter dimples located in different regions do not have the same edge angle. Thus, in a further particular aspect of the embodiment shown in FIGS. 5A-5C, the dimples labelled 1-5 have the diameters and edge angles given in Table 3 below.

TABLE 3

| Region | Numerical Label | Dimple Diameter (inches) | Edge Angle (°) |
|---|---|---|---|
| polar | 1 | 0.128 | 13.00 |
| polar | 2 | 0.150 | 13.00 |
| polar | 3 | 0.160 | 13.00 |
| intermediate | 1 | 0.128 | 13.50 |
| intermediate | 2 | 0.150 | 13.50 |
| intermediate | 3 | 0.160 | 13.50 |

TABLE 3-continued

| Region | Numerical Label | Dimple Diameter (inches) | Edge Angle (°) |
|---|---|---|---|
| intermediate | 4 | 0.170 | 13.50 |
| equatorial | 3 | 0.160 | 14.00 |
| equatorial | 4 | 0.170 | 14.00 |
| equatorial | 5 | 0.180 | 14.00 |

average edge angle of dimples of polar region 13.00°
average edge angle of dimples of intermediate region 13.50°
average edge angle of dimples of equatorial region 14.00°

In another further particular aspect of the embodiment shown in FIGS. 5A-5C, the dimples labelled 1-5 have the diameters and edge angles given in Table 4 below.

TABLE 4

| Region | Numerical Label | Dimple Diameter (inches) | Edge Angle (°) |
|---|---|---|---|
| polar | 1 | 0.128 | 13.00 |
| polar | 2 | 0.150 | 13.30 |
| polar | 3 | 0.160 | 13.30 |
| intermediate | 1 | 0.128 | 13.50 |
| intermediate | 2 | 0.150 | 13.80 |
| intermediate | 3 | 0.160 | 14.20 |
| intermediate | 4 | 0.170 | 14.20 |
| equatorial | 3 | 0.160 | 14.00 |
| equatorial | 4 | 0.170 | 14.30 |
| equatorial | 5 | 0.180 | 14.60 |

average edge angle of dimples of polar region 13.24°
average edge angle of dimples of intermediate region 13.89°
average edge angle of dimples of equatorial region 14.36°

Thus, according to the embodiment shown in FIGS. 5A-5B, and wherein the dimples have properties according to Table 2 or Table 3 or Table 4, the dimples have a total of five different dimple diameters, including a minimum dimple diameter of 0.128 inches and a maximum dimple diameter of 0.180. The total number of dimples on the ball having the minimum dimple diameter is forty, and the total number of dimples on the ball having the maximum dimple diameter is sixty-four.

FIGS. 5B & 5C show lines drawn at latitude angle 30° and latitude angle 60°, thereby dividing the triangular dimple section 10 into a polar region 15, an intermediate region 17, and an equatorial region 19. In FIG. 5C, the alphabetical labels within the dimples designate the region in which the dimple is located; i.e., all dimples labelled A are located in the polar region 15, all dimples labelled B are located in the intermediate region 17, and all dimples labelled C are located in the equatorial region 19.

Thus, according to the embodiment shown in FIGS. 5A-5C, and wherein the dimples have properties according to Table 2 or Table 3 or Table 4, the triangular dimple section 10 has the following properties:

a) the polar region 15 includes one dimple that has the minimum dimple diameter, the latitude angle of which is about 15°;

b) the polar region 15 does not include a dimple having the maximum dimple diameter;

c) the intermediate region 17 includes four dimples having the minimum dimple diameter;

d) the intermediate region 17 does not include a dimple having the maximum dimple diameter;

e) the equatorial region 19 includes ten dimples having the maximum dimple diameter, including six non-shared equatorial dimples and four side edge dimples;

f) the equatorial region 19 does not include a dimple having the minimum dimple diameter;

g) the intermediate region 17 includes four different dimple diameters, the polar region 15 includes three different diameters, and the equatorial region 19 includes three different diameters; thus, the number of different dimple diameters located in the intermediate region 17 is greater than the number of different dimple diameters located in the polar region 15 and greater than the number of different dimple diameters located in the equatorial region 19, and the number of different dimple diameters located in the polar region 15 is equal to the number of different dimple diameters located in the equatorial region 19;

h) the polar region 15 has a surface coverage $S_p$ of 64.2%;

i) the intermediate region 17 has a surface coverage $S_i$ of 74.8%; and j) the equatorial region 19 has a surface coverage $S_e$ 88.1%.

Non-Limiting Exemplary Dimple Pattern 3

Figure 6A:
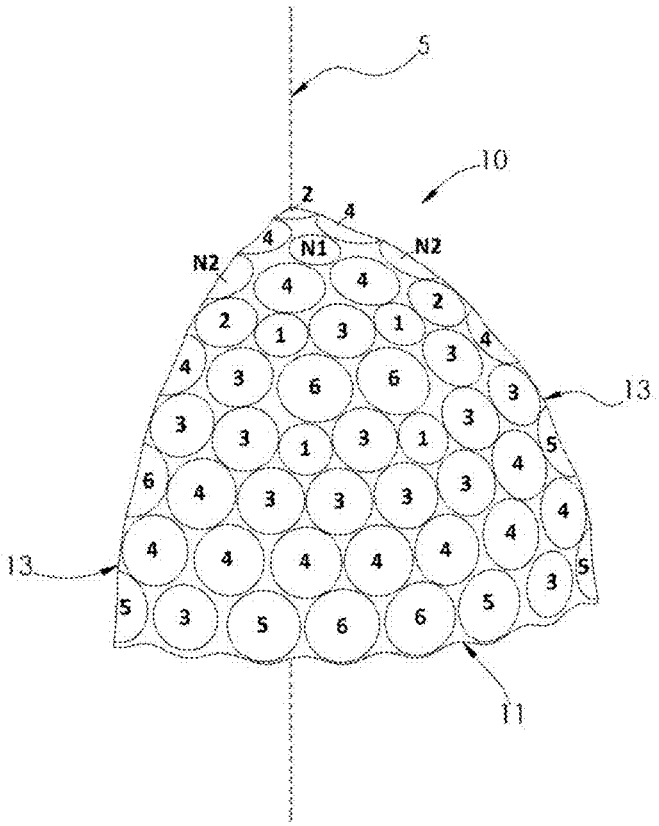
FIGS. 6A-6B illustrate the face of FIG. 2 with dimples arranged therein according to an embodiment of the present invention.
Figure 6B:
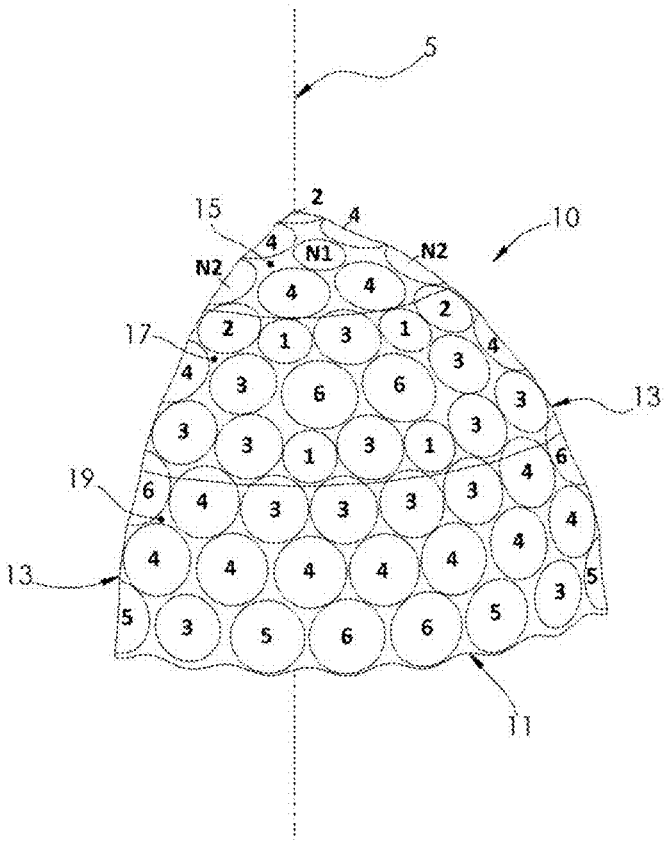

A triangular section of a dimple pattern based on a square dipyramid according to a particular embodiment of the present invention is illustrated in FIGS. 6A-6B. FIGS. 6A-6B show a triangular dimple section 10 packed with dimples into a dimple arrangement consisting of: thirty-two non-intersecting dimples, one polar dimple, ten side edge dimples, and six non-shared equatorial dimples. Thus, a golf ball having a dimple pattern based on a square dipyramid, with each triangular dimple section having the dimple arrangement shown in FIGS. 6A-6B, has a total of 346 dimples, with a surface coverage of about 81.0%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 6A-6B, the dimples having a numerical label have a circular plan shape, and the numerical labels within the dimples designate same diameter dimples; i.e., all dimples labelled 1 have substantially the same diameter, all dimples labelled 2 have substantially the same diameter, and so on. In a particular aspect of the embodiment illustrated in FIGS. 6A-6B, the dimples labelled 1-6 have the diameters given in Table 5 below:

TABLE 5

| Numerical Label | Dimple Diameter (inches) |
|---|---|
| 1 | 0.128 |
| 2 | 0.150 |
| 3 | 0.160 |
| 4 | 0.170 |
| 5 | 0.175 |
| 6 | 0.180 |

In FIGS. 6A-6B, the dimples having an alphanumerical label have an elliptical plan shape, and the alphanumerical labels within the dimples designate dimples having major and minor axes of substantially the same length; i.e., all dimples labelled N1 have substantially the same length major axis and substantially the same length minor axis, all dimples labelled N2 have substantially the same length major axis and substantially the same length minor axis, and so on. In a particular aspect of the embodiment illustrated in FIGS. 6A-6B, the dimples labelled N1 and N2 have the properties given in Table 6 below:

TABLE 6

| Alphanumerical Label | Minor Axis Length (inches) | Major Axis Length (inches) |
|---|---|---|
| N1 | 0.123 | 0.127 |
| N2 | 0.150 | 0.163 |

Thus, according to the embodiment shown in FIGS. 6A-6B, and wherein the dimples have properties according to Tables 5 and 6, the dimples include circular plan shaped dimples having a total of six different dimple diameters, including a minimum dimple diameter of 0.128 inches and a maximum dimple diameter of 0.180, and elliptical plan shaped dimples of a first type N1 and a second type N2, the first type N1 having a difference between the length of the major axis and the length of the minor axis of 0.004 inches and a ratio of the length of the major axis to the length of the minor axis of 1.03, and the second type N2 having a difference between the length of the major axis and the length of the minor axis of 0.013 inches and a ratio of the length of the major axis to the length of the minor axis of 1.09.

FIG. 6B shows lines drawn at latitude angle 30° and latitude angle 60°, thereby dividing the triangular dimple section 10 into a polar region 15, an intermediate region 17, and an equatorial region 19. As shown in FIG. 6B, each dimple having an elliptical plan shape is located in the polar region 15. Additionally, according to the embodiment shown in FIGS. 6A-6B, and wherein the dimples have properties according to Tables 5 and 6, the triangular dimple section 10 has the following properties:

a) the polar region 15 has a surface coverage $S_p$ of 70.0%;

b) the intermediate region 17 has a surface coverage $S_i$ of 79.2%; and c) the equatorial region 19 has a surface coverage $S_e$ 85.4%.

Non-Limiting Exemplary Dimple Pattern 4

Figure 7:
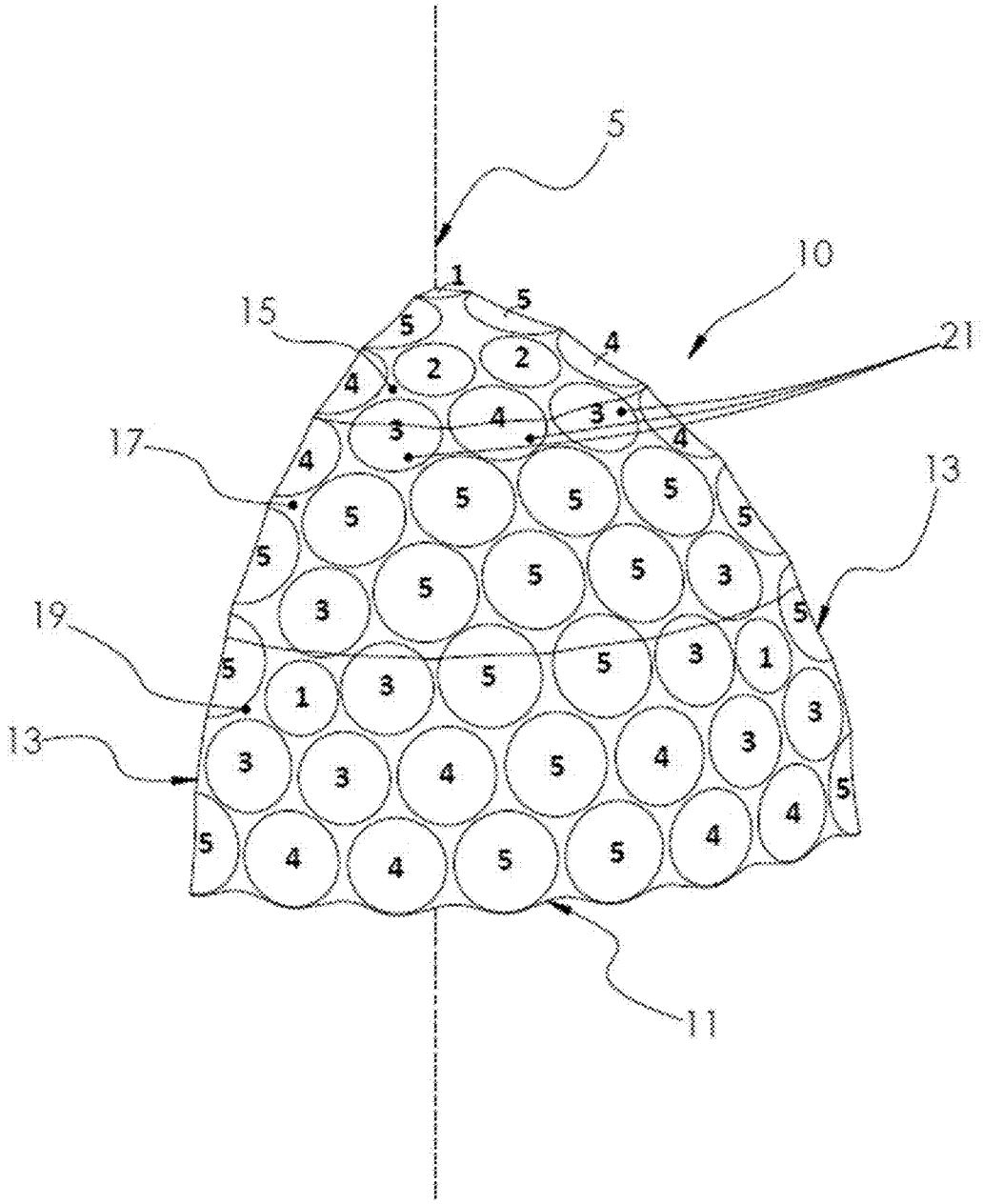
FIG. 7 illustrates the face of FIG. 2 with dimples arranged therein according to an embodiment of the present invention.

A triangular section of a dimple pattern based on a square dipyramid according to a particular embodiment of the present invention is illustrated in FIG. 7. FIG. 7 shows a triangular dimple section 10 packed with dimples into a dimple arrangement consisting of: twenty-seven non-intersecting dimples, one polar dimple, ten side edge dimples, six shared equatorial dimples and two base vertex dimples. Thus, a golf ball having a dimple pattern based on a square dipyramid, with each triangular dimple section having the dimple arrangement shown in FIG. 7, has a total of 314 dimples, with a surface coverage of about 78.6%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIG. 7, the numerical labels within the dimples designate same diameter dimples; i.e., all dimples labelled 1 have substantially the same diameter, all dimples labelled 2 have substantially the same diameter, and so on. In a particular aspect of the embodiment illustrated in FIG. 7, same diameter dimples also have substantially the same chord depth and substantially the same edge angle. In another particular aspect of the embodiment illustrated in FIG. 7, the dimples labelled 1-5 have the diameters given in Table 7 below:

TABLE 7

| Numerical Label | Dimple Diameter (inches) |
|---|---|
| 1 | 0.130 |
| 2 | 0.140 |
| 3 | 0.150 |
| 4 | 0.160 |
| 5 | 0.170 |

FIG. 7 shows lines drawn at latitude angle 30° and latitude angle 60°, thereby dividing the triangular dimple section 10 into a polar region 15, an intermediate region 17, and an equatorial region 19. Each of three dimples 21 has a centroid that lies at a latitude angle of from 28° to 32°; thus, the three dimples 21 are shared between the polar region 15 and the intermediate region 17.

The polar region 15 has a surface coverage $S_p$ of 76.6%. The intermediate region 17 has a surface coverage $S_i$ of 73.4%. The equatorial region 19 has a surface coverage $S_e$ 83.3%.

Non-Limiting Exemplary Dimple Pattern 5

Figure 8:
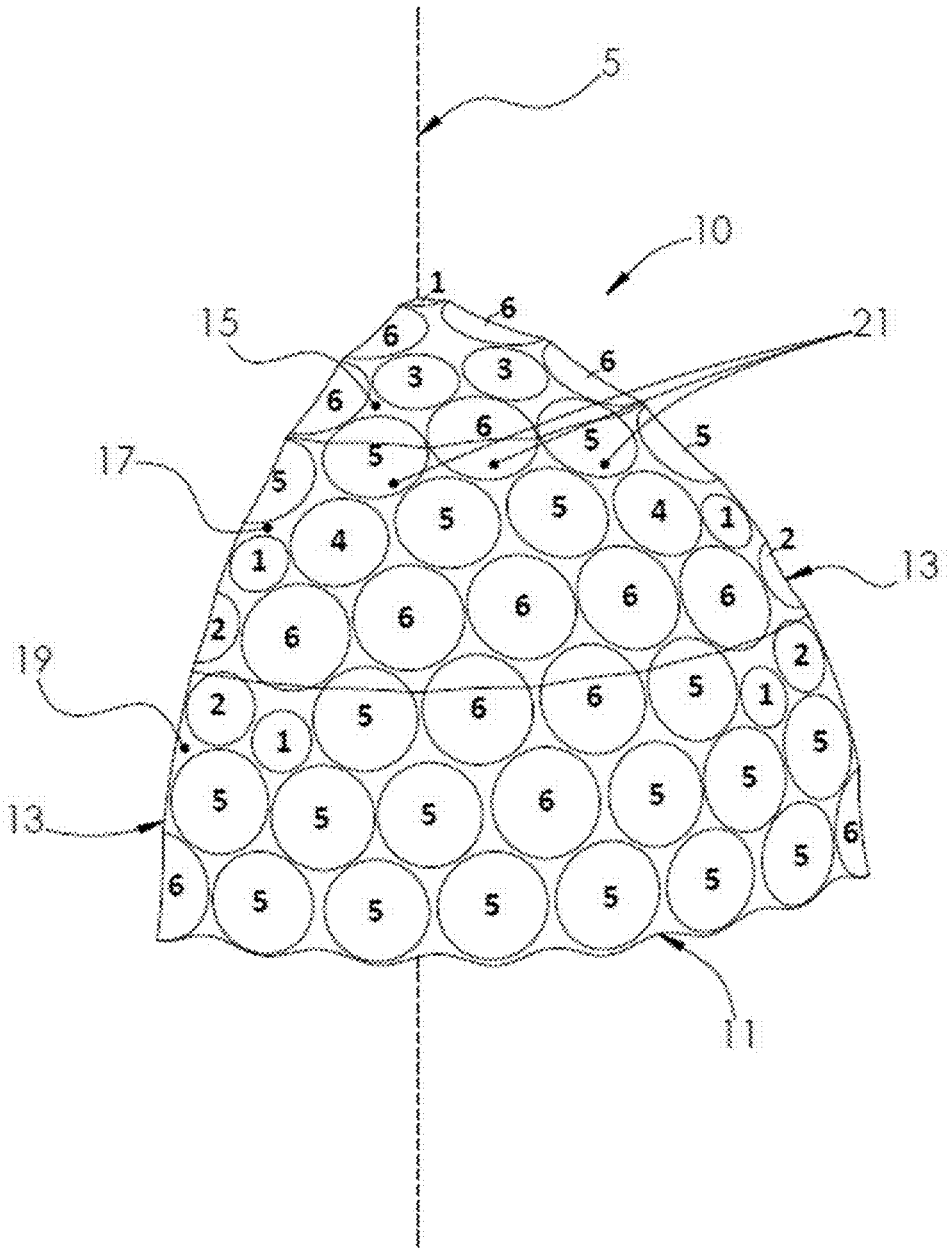
FIG. 8 illustrates the face of FIG. 2 with dimples arranged therein according to an embodiment of the present invention.

A triangular section of a dimple pattern based on a square dipyramid according to a particular embodiment of the present invention is illustrated in FIG. 8. FIG. 8 shows a triangular dimple section 10 packed with dimples into a dimple arrangement consisting of: thirty-one non-intersecting dimples, one polar dimple, eight side edge dimples, six shared equatorial dimples and two base vertex dimples. Thus, a golf ball having a dimple pattern based on a square dipyramid, with each triangular dimple section having the dimple arrangement shown in FIG. 8, has a total of 338 dimples, with a surface coverage of about 79.2%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIG. 8, the numerical labels within the dimples designate same diameter dimples; i.e., all dimples labelled 1 have substantially the same diameter, all dimples labelled 2 have substantially the same diameter, and so on. In a particular aspect of the embodiment illustrated in FIG. 8, same diameter dimples also have substantially the same chord depth and substantially the same edge angle. In another particular aspect of the embodiment illustrated in FIG. 8, the dimples labelled 1-6 have the diameters given in Table 8 below:

TABLE 8

| Numerical Label | Dimple Diameter (inches) |
|---|---|
| 1 | 0.100 |
| 2 | 0.120 |

TABLE 8-continued

| Numerical Label | Dimple Diameter (inches) |
|---|---|
| 3 | 0.140 |
| 4 | 0.160 |
| 5 | 0.170 |
| 6 | 0.180 |

FIG. 8 shows lines drawn at latitude angle 30° and latitude angle 60°, thereby dividing the triangular dimple section 10 into a polar region 15, an intermediate region 17, and an equatorial region 19. Each of three dimples 21 has a centroid that lies at a latitude angle of from 28° to 32°; thus, the three dimples 21 are shared between the polar region 15 and the intermediate region 17.

The polar region 15 has a surface coverage $S_p$ of 80.2%. The intermediate region 17 has a surface coverage $S_i$ of 73.4%. The equatorial region 19 has a surface coverage $S_e$ 83.6%.

Non-Limiting Exemplary Dimple Pattern 6

Figure 9:
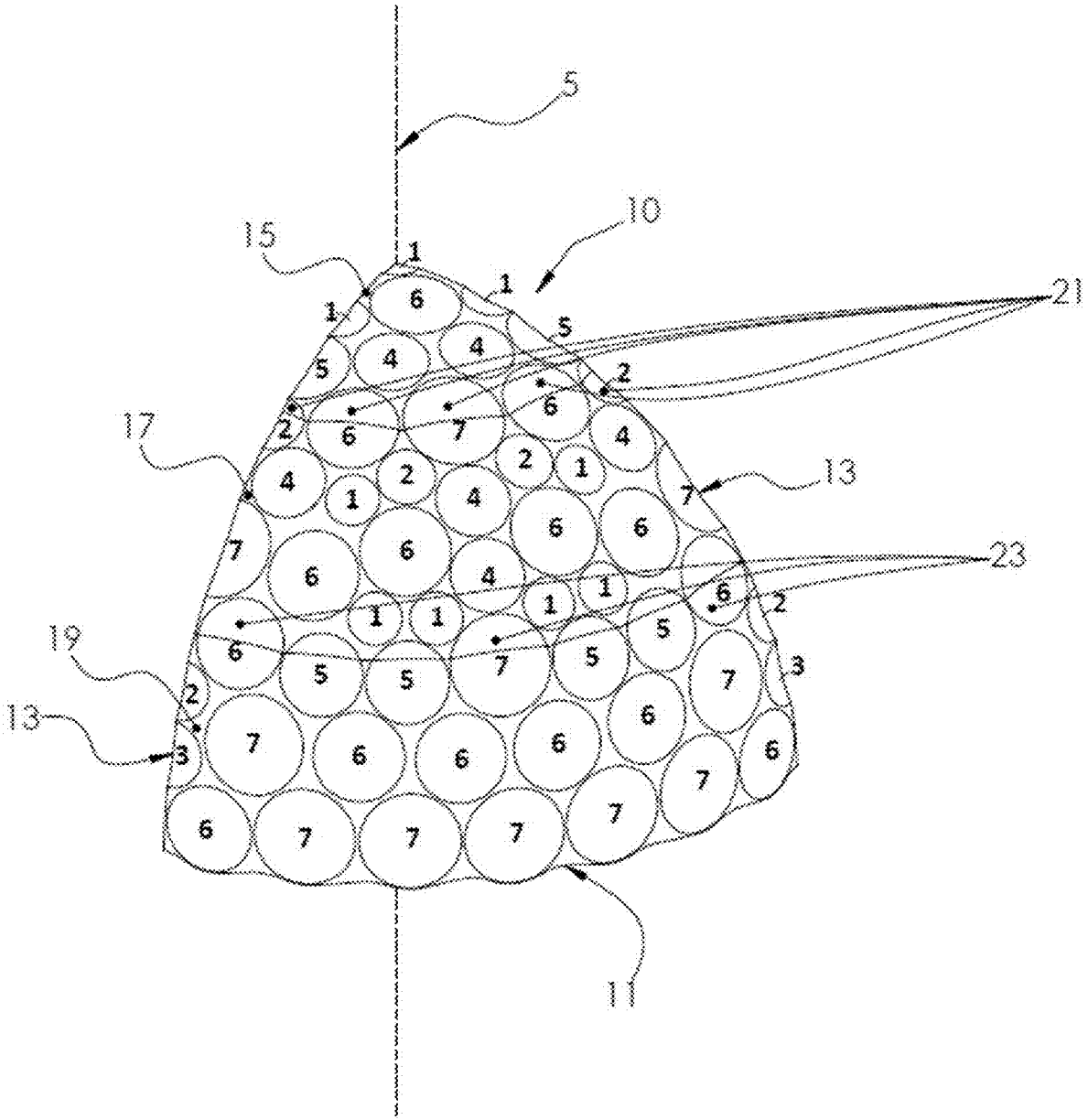
FIG. 9 illustrates the face of FIG. 2 with dimples arranged therein according to an embodiment of the present invention.

A triangular section of a dimple pattern based on a square dipyramid according to a particular embodiment of the present invention is illustrated in FIG. 9. FIG. 9 shows a triangular dimple section 10 packed with dimples into a dimple arrangement consisting of: thirty-five non-intersecting dimples, one polar dimple, twelve side edge dimples, and seven shared equatorial dimples. Thus, a golf ball having a dimple pattern based on a square dipyramid, with each triangular dimple section having the dimple arrangement shown in FIG. 9, has a total of 386 dimples, with a surface coverage of about 82.6%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIG. 9, the numerical labels within the dimples designate same diameter dimples; i.e., all dimples labelled 1 have substantially the same diameter, all dimples labelled 2 have substantially the same diameter, and so on. In a particular aspect of the embodiment illustrated in FIG. 9, same diameter dimples also have substantially the same chord depth and substantially the same edge angle. In another particular aspect of the embodiment illustrated in FIG. 9, the dimples labelled 1-7 have the diameters given in Table 9 below:

TABLE 9

| Numerical Label | Dimple Diameter (inches) |
|---|---|
| 1 | 0.100 |
| 2 | 0.110 |
| 3 | 0.125 |
| 4 | 0.140 |
| 5 | 0.155 |
| 6 | 0.170 |
| 7 | 0.190 |

FIG. 9 shows lines drawn at latitude angle 30° and latitude angle 60°, thereby dividing the triangular dimple section 10 into a polar region 15, an intermediate region 17, and an equatorial region 19. Each of five dimples 21 has a centroid that lies at a latitude angle of from 28° to 32°; thus, the five dimples 21 are shared between the polar region 15 and the intermediate region 17. Each of three dimples 23 has a centroid that lies at a latitude angle of from 58° to 62°; thus, the three dimples 23 are shared between the intermediate region 17 and the equatorial region 19.

The polar region 15 has a surface coverage $S_p$ of 83.4%. The intermediate region 17 has a surface coverage $S_i$ of 80.2%. The equatorial region 19 has a surface coverage $S_e$ 84.6%.

Non-Limiting Exemplary Dimple Pattern 7

Figure 10A:
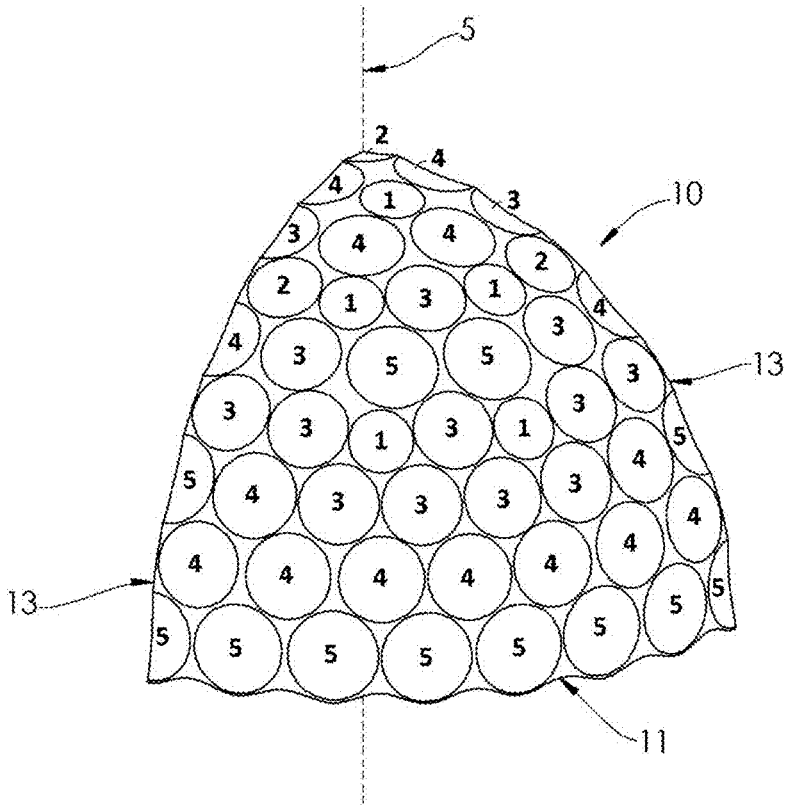
FIG. 10A-10C illustrate the face of FIG. 2 with dimples arranged therein according to an embodiment of the present invention.
Figure 10B:
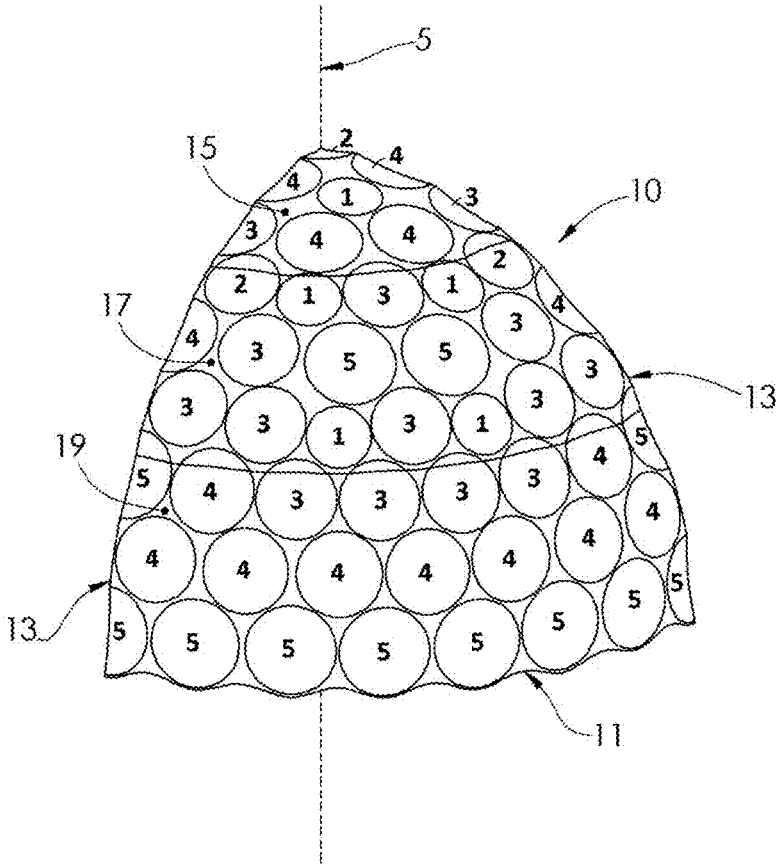
Figure 10C:
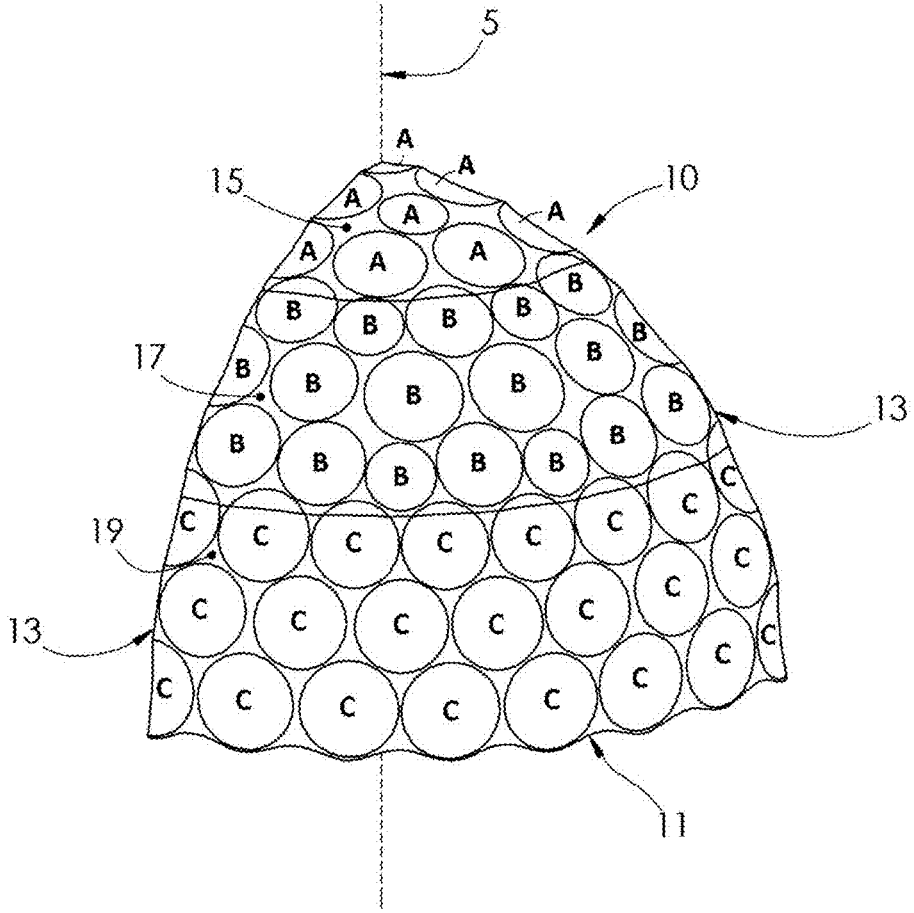

A triangular section of a dimple pattern based on a square dipyramid according to a particular embodiment of the present invention is illustrated in FIGS. 10A-10C. FIGS. 10A-10C show a triangular dimple section 10 packed with dimples into a dimple arrangement consisting of: thirty-two non-intersecting dimples, one polar dimple, eight side edge dimples, six non-shared equatorial dimples, and two base vertex dimples. Thus, a golf ball having a dimple pattern based on a square dipyramid, with each triangular dimple section having the dimple arrangement shown in FIGS. 10A-10C, has a total of 346 dimples, with a surface coverage of about 82.4%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 10A-10B, the numerical labels within the dimples designate same diameter dimples; i.e., all dimples labelled 1 have substantially the same diameter, all dimples labelled 2 have substantially the same diameter, and so on. In a particular aspect of the embodiment illustrated in FIGS. 10A-10C, same diameter dimples also have substantially the same chord depth and substantially the same edge angle. In a further particular aspect of the embodiment illustrated in FIGS. 10A-10C, the dimples labelled 1-5 have the diameters given in Table 10 below:

TABLE 10

| Numerical Label | Dimple Diameter (inches) |
|---|---|
| 1 | 0.128 |
| 2 | 0.150 |
| 3 | 0.160 |
| 4 | 0.170 |
| 5 | 0.180 |

Thus, according to the embodiment shown in FIGS. 10A-10C, and wherein the dimples have properties according to Table 10, the dimples have a total of five different dimple diameters, including a minimum dimple diameter of 0.128 inches and a maximum dimple diameter of 0.180.

FIGS. 10B & 10C show lines drawn at latitude angle 30° and latitude angle 60°, thereby dividing the triangular dimple section 10 into a polar region 15, an intermediate region 17, and an equatorial region 19. In FIG. 10C, the alphabetical labels within the dimples designate the region in which the dimple is located; i.e., all dimples labelled A are located in the polar region 15, all dimples labelled B are located in the intermediate region 17, and all dimples labelled C are located in the equatorial region 19.

The polar region 15 has a surface coverage $S_p$ of 71.0%. The intermediate region 17 has a surface coverage $S_i$ of 79.2%. The equatorial region 19 has a surface coverage $S_e$ 88.1%.

Non-Limiting Exemplary Dimple Pattern 8

Figure 11A:
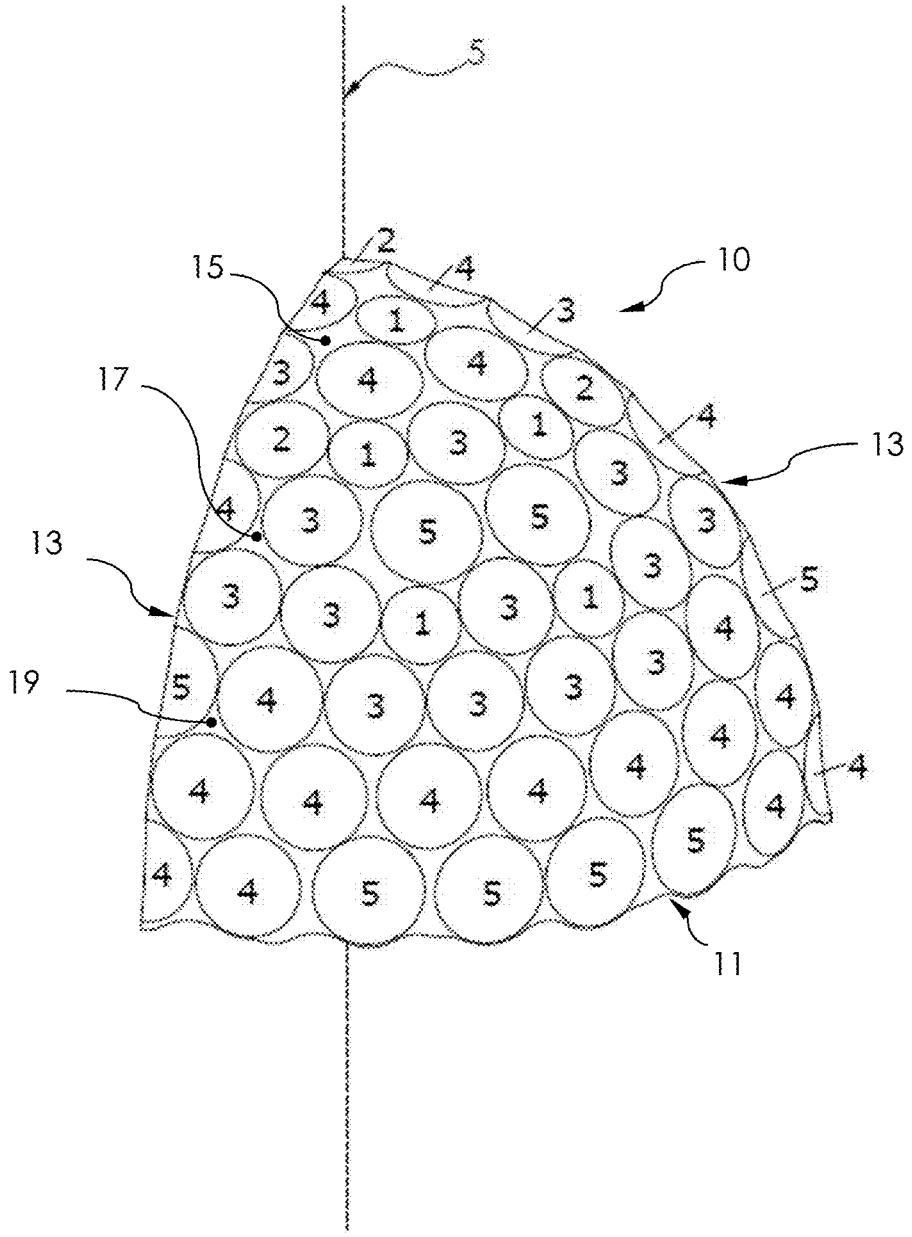
FIG. 11A illustrates the face of FIG. 2 with dimples arranged therein according to an embodiment of the present invention.
Figure 11B:
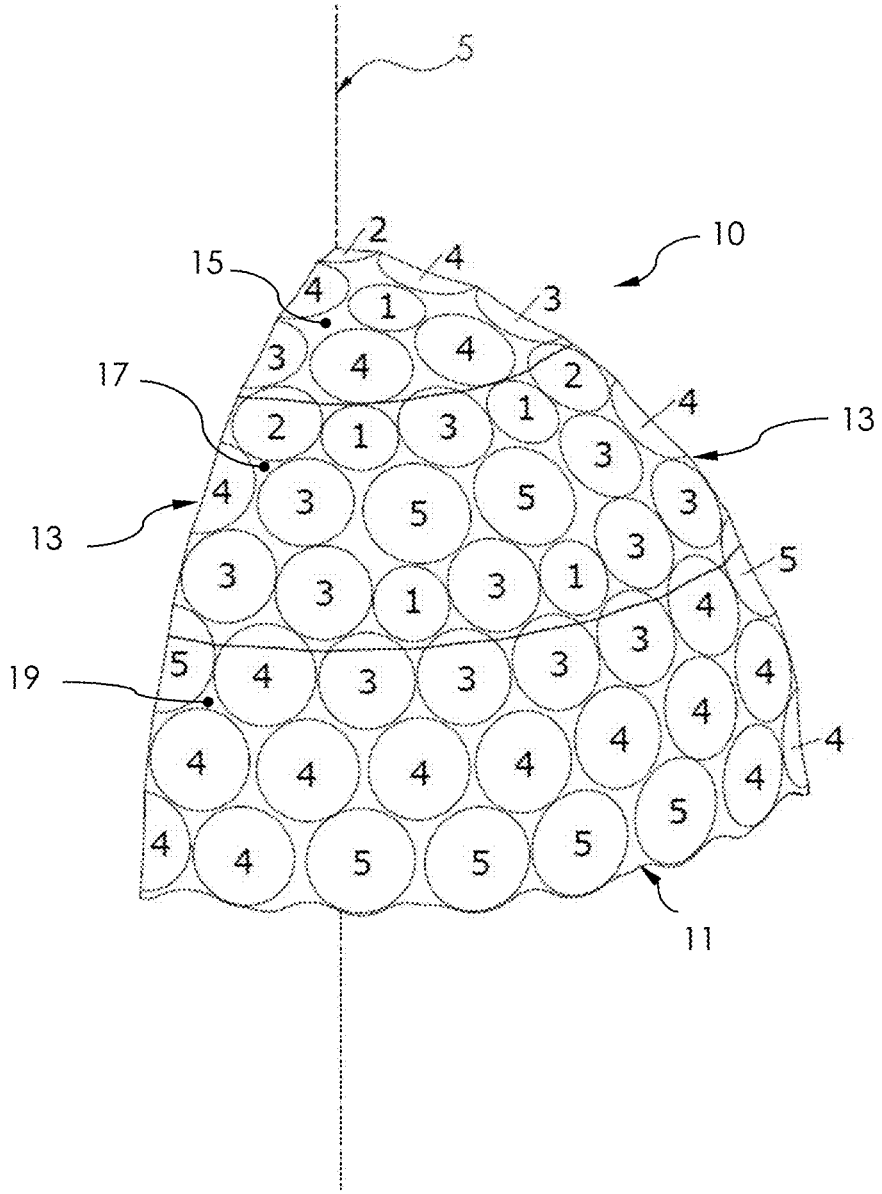
FIG. 11B illustrates the same face as FIG. 11A with different annotations to emphasize additional aspects.
Figure 11C:
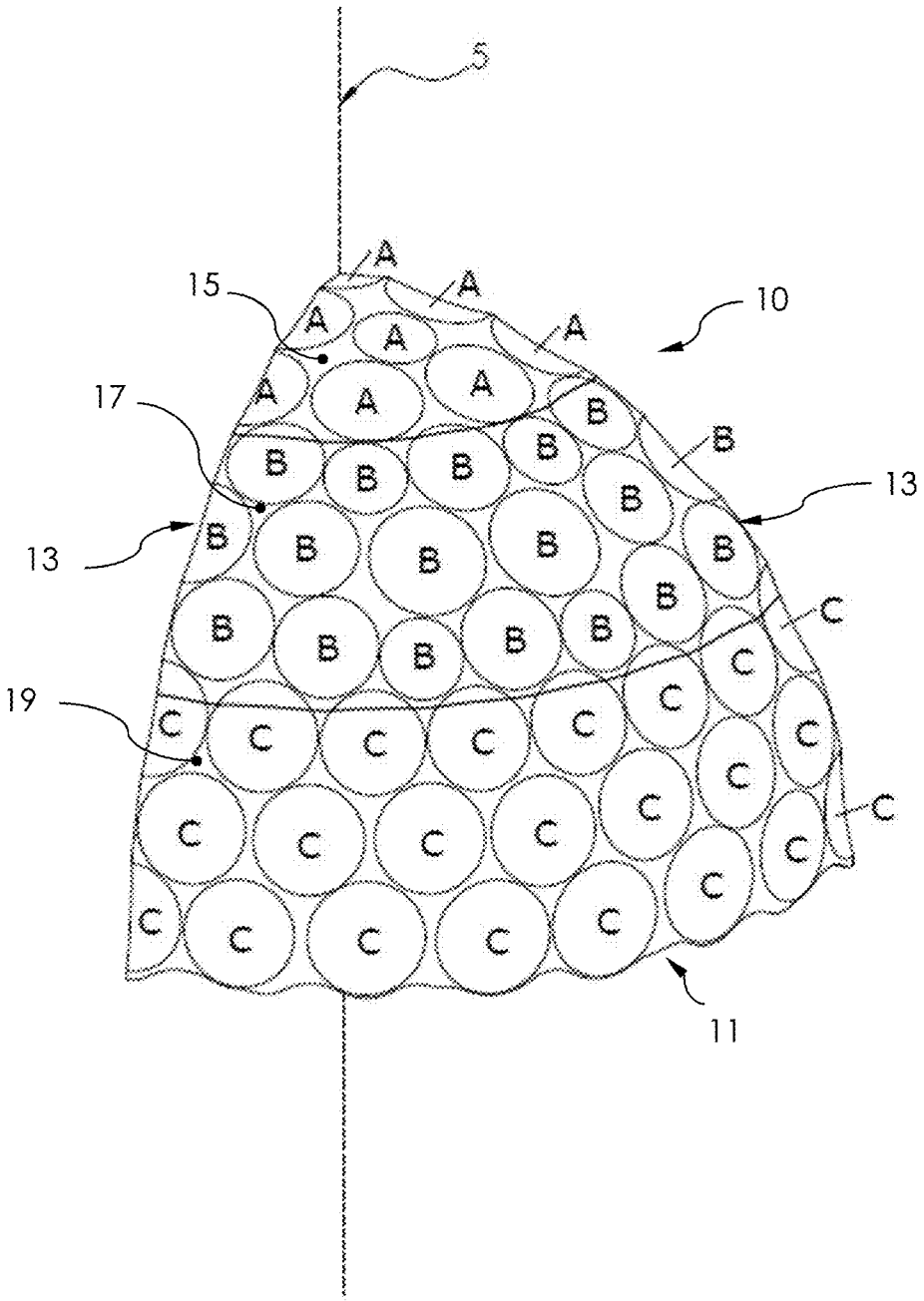
FIG. 11C illustrates the same face as FIGS. 11A and 11B with different annotations to emphasize additional aspects.
Figure 11D:
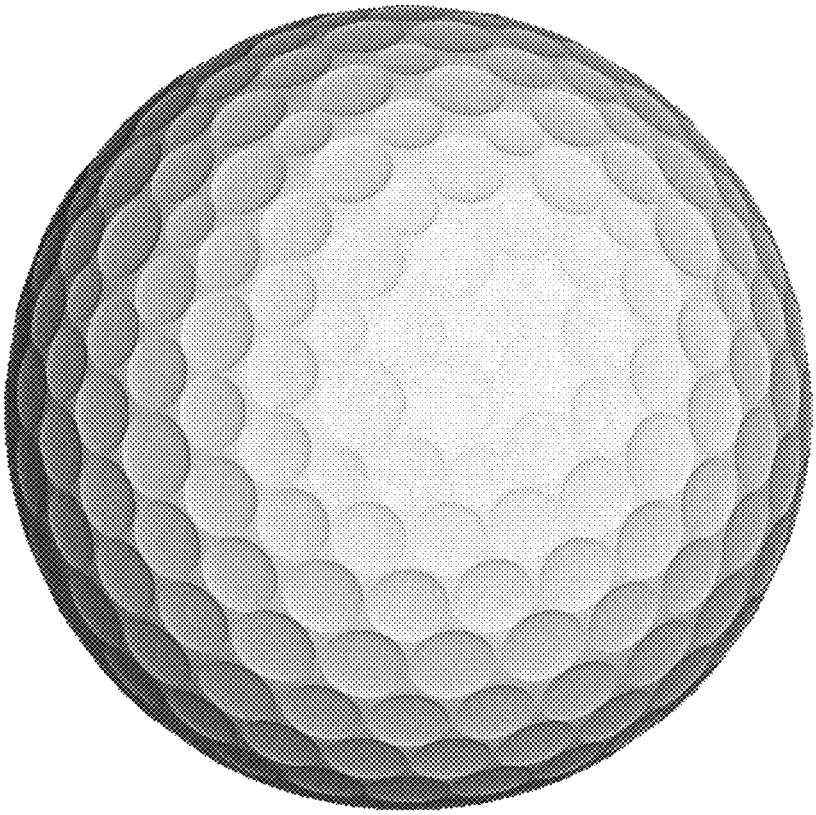
FIG. 11D illustrates a golf ball having dimples arranged according to the pattern shown in FIGS. 11A-11C.

A triangular section of a dimple pattern based on a square dipyramid according to a particular embodiment of the present invention is illustrated in FIGS. 11A-11D. FIGS. 11A-11C show a triangular dimple section 10 packed with dimples into a dimple arrangement consisting of: thirty-two non-intersecting dimples, one polar dimple, ten side edge dimples, and six non-shared equatorial dimples. Thus, a golf ball, which is shown in its totality in FIG. 11D, having a dimple pattern based on a square dipyramid with each triangular dimple section having the dimple arrangement shown in FIGS. 11A-11C, has a total of 346 dimples, with a surface coverage of about 82.1%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 11A and 11B, the dimples having a numerical label have a circular plan shape, and the numerical labels within the dimples designate same diameter dimples; i.e., all dimples labelled 1 have substantially the same diameter, all dimples labelled 2 have substantially the same diameter, and so on. In a particular aspect of the embodiment illustrated in FIGS. 11A and 11B, same diameter dimples also have substantially the same chord depth and substantially the same edge angle. In a further particular aspect of the embodiment illustrated in FIGS. 11A and 11B, the dimples labelled 1-5 have the diameters given in Table 11 below:

TABLE 11

| Numerical Label | Dimple Diameter (inches) |
|---|---|
| 1 | 0.128 |
| 2 | 0.150 |
| 3 | 0.160 |
| 4 | 0.170 |
| 5 | 0.180 |

Thus, according to the embodiment shown in FIGS. 11A-11D, and wherein the dimples have properties according to Table 11, the dimples have a total of five different dimple diameters, including a minimum dimple diameter of 0.128 inches and a maximum dimple diameter of 0.180.

FIG. 11B shows lines drawn at latitude angle 30° and latitude angle 60°, thereby dividing the triangular dimple section 10 into a polar region 15, an intermediate region 17, and an equatorial region 19. In FIG. 11C, the alphabetical labels within the dimples designate the region in which the dimple is located; i.e., all dimples labelled A are located in the polar region 15, all dimples labelled B are located in the intermediate region 17, and all dimples labelled C are located in the equatorial region 19.

The polar region 15 has a surface coverage $S_p$ of 73.5%. The intermediate region 17 has a surface coverage $S_i$ of 79.2%. The equatorial region 19 has a surface coverage $S_e$ 86.6%.

Non-Limiting Exemplary Dimple Pattern 9

Figure 12A:
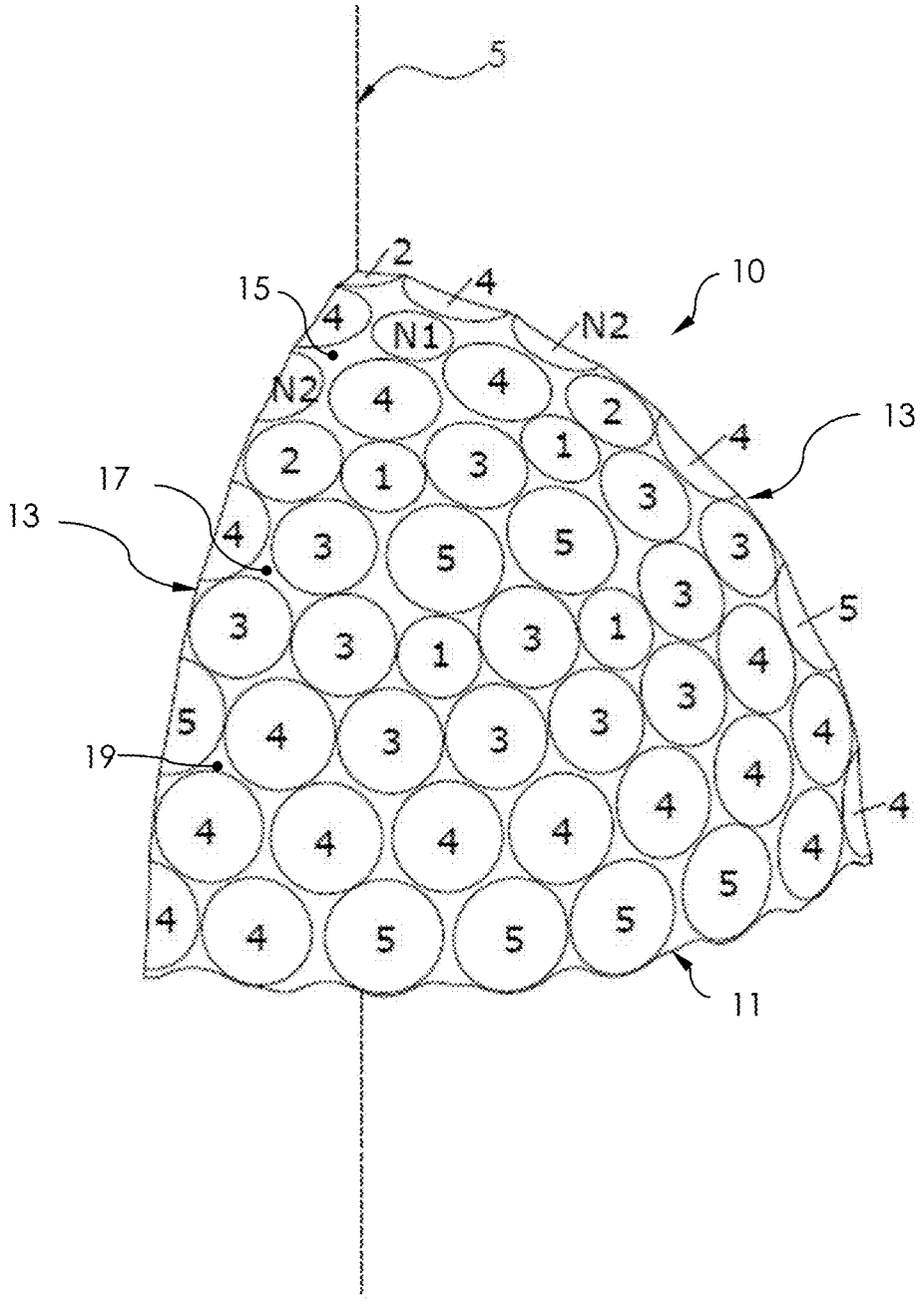
FIG. 12A illustrates the face of FIG. 2 with dimples arranged therein according to an embodiment of the present invention.
Figure 12B:
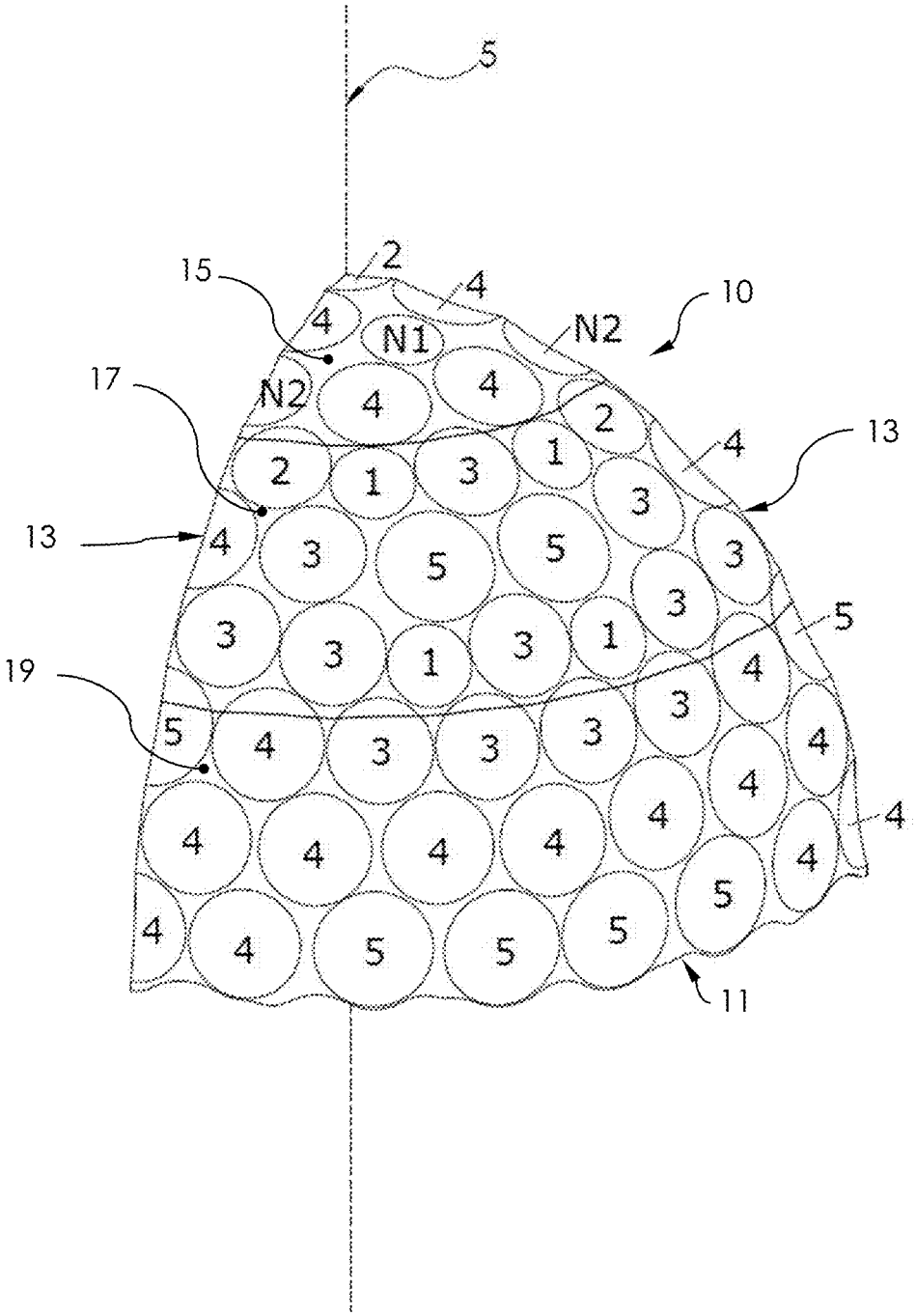
FIG. 12B illustrates the same face as FIG. 12A with different annotations to emphasize additional aspects.
Figure 12C:
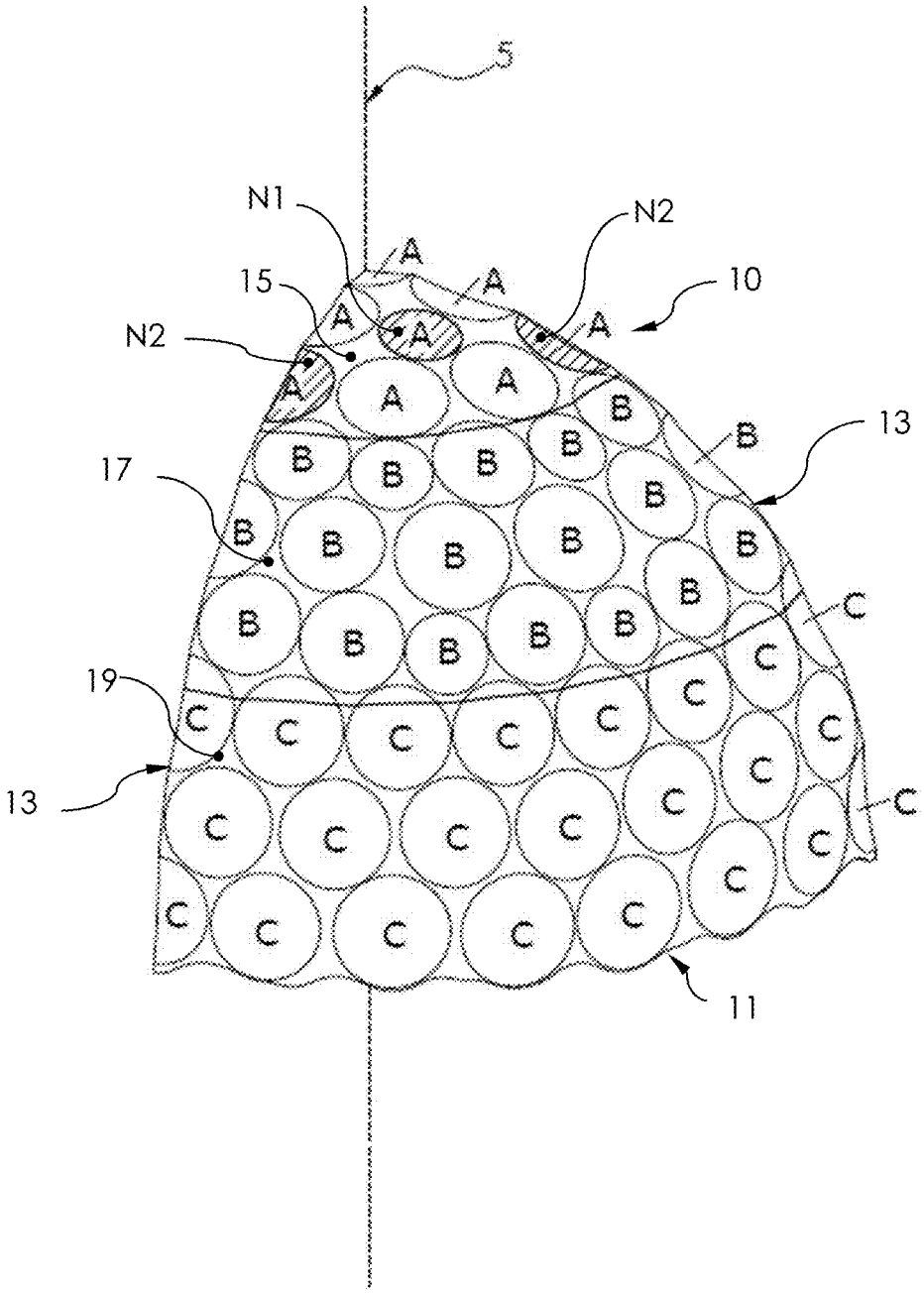
FIG. 12C illustrates the same face as FIGS. 12A and 12B with different annotations to emphasize additional aspects.
Figure 12D:
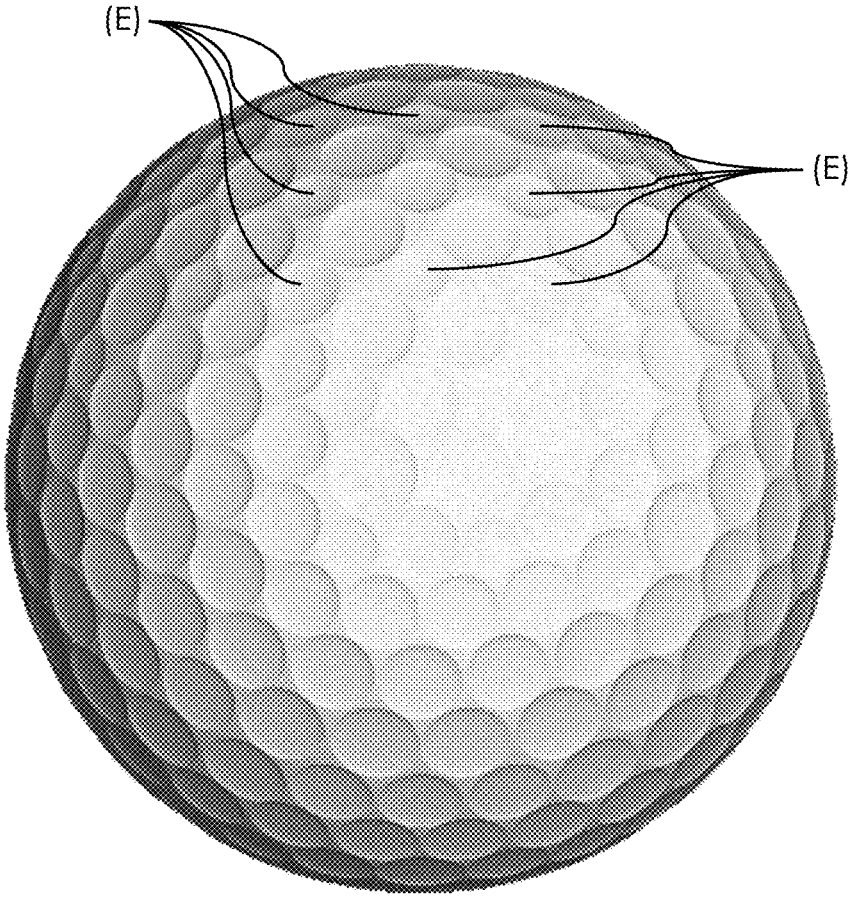
FIG. 12D illustrates a golf ball having dimples arranged according to the pattern shown in FIGS. 12A-12C.

A triangular section of a dimple pattern based on a square dipyramid according to a particular embodiment of the present invention is illustrated in FIGS. 12A-12D. FIGS. 12A-12C show a triangular dimple section 10 packed with dimples into a dimple arrangement consisting of: thirty-two non-intersecting dimples, one polar dimple, ten side edge dimples, and six non-shared equatorial dimples. Thus, a golf ball, which is shown in its totality in FIG. 12D, having a dimple pattern based on a square dipyramid, with each triangular dimple section having the dimple arrangement shown in FIGS. 12A-12C, has a total of 346 dimples, with a surface coverage of about 82.0%. The golf ball has a non-planar parting line that is defined by a drawing a non-linear segment 11 along the path of each equatorial edge. To provide for dimples in the pattern whose perimeters are intersected by an equatorial edge, the dimple pattern has a rotational offset between the two hemispheres of about 45°. There are no dimple free great circles on the outer surface of the ball.

In FIGS. 12A and 12B, the dimples having a numerical label have a circular plan shape, and the numerical labels within the dimples designate same diameter dimples; i.e., all dimples labelled 1 have substantially the same diameter, all dimples labelled 2 have substantially the same diameter, and so on. In a particular aspect of the embodiment illustrated in FIGS. 12A and 12B, same diameter dimples also have substantially the same chord depth and substantially the same edge angle. In a further particular aspect of the embodiment illustrated in FIGS. 12A and 12B, the dimples labelled 1-5 have the diameters given in Table 12 below:

TABLE 12

| Numerical Label | Dimple Diameter (inches) |
|---|---|
| 1 | 0.128 |
| 2 | 0.150 |
| 3 | 0.160 |
| 4 | 0.170 |
| 5 | 0.180 |

Thus, according to the embodiment shown in FIGS. 12A-12D, and wherein the dimples have properties according to Table 12, the dimples having a circular plan shape have a total of five different dimple diameters, including a minimum dimple diameter of 0.128 inches and a maximum dimple diameter of 0.180.

In FIGS. 12A-12C, the dimples having an alphanumerical label have an elliptical plan shape, and the alphanumerical labels within the dimples designate dimples having major and minor axes of substantially the same length; i.e., all dimples labelled N1 have substantially the same length major axis and substantially the same length minor axis, all dimples labelled N2 have substantially the same length major axis and substantially the same length minor axis, and so on. The dimples having an elliptical plan shape are labelled "(E)" in FIG. 12D. In a particular aspect of the embodiment illustrated in FIGS. 12A-12C, the dimples labelled N1 and N2 have the properties given in Table 13 below:

TABLE 13

| Alphanumerical Label | Minor Axis Length (inches) | Major Axis Length (inches) |
|---|---|---|
| N1 | 0.123 | 0.127 |
| N2 | 0.150 | 0.163 |

Thus, according to the embodiment shown in FIGS. 12A-12D, and wherein the dimples have properties according to Tables 12 and 13, the dimples include circular plan shaped dimples having a total of five different dimple diameters, including a minimum dimple diameter of 0.128 inches and a maximum dimple diameter of 0.180, and elliptical plan shaped dimples of a first type N1 and a second type N2, the first type N1 having a difference between the length of the major axis and the length of the minor axis of 0.004 inches and a ratio of the length of the major axis to the length of the minor axis of 1.033, and the second type N2 having a difference between the length of the major axis and the length of the minor axis of 0.013 inches and a ratio of the length of the major axis to the length of the minor axis of 1.087.

Each dimple having an elliptical plan shape can have a first shape factor along a major axis, and a second shape factor along a minor axis, and the first and second shape factors for each respective dimple can be identical. In another aspect, each dimple having an elliptical plan shape can have a first shape factor along a major axis, and a second shape factor along a minor axis, and the first and second shape factors for each respective dimple can be different. The difference in said shape factors can be at least 5, or at least 20, or at least 50. In one aspect, the elliptical dimple N1 can have a first shape factor of 35 and a second shape factor of 60, and the elliptical dimple N2 can have a first shape factor of 20 and a second shape factor of 95. In another aspect, the elliptical dimple N1 can have a first shape factor of 55 and a second shape factor of 40, and the elliptical dimple N2 can have a first shape factor of 50 and a second shape factor of 45. In another aspect, the elliptical dimple N1 can have a first shape factor of 20-60 and a second shape factor of 30-70, and the elliptical dimple N2 can have a first shape factor of 10-60 and a second shape factor of 35-105.

FIGS. 12B and 12C show lines drawn at latitude angle 30° and latitude angle 60°, thereby dividing the triangular dimple section 10 into a polar region 15, an intermediate region 17, and an equatorial region 19. In FIG. 12C, the alphabetical labels within the dimples designate the region in which the dimple is located; i.e., all dimples labelled A are located in the polar region 15, all dimples labelled B are located in the intermediate region 17, and all dimples labelled C are located in the equatorial region 19.

According to the embodiment shown in FIGS. 12A-12D, the polar region 15 has a surface coverage $S_p$ of 72.8%. The intermediate region 17 has a surface coverage $S_i$ of 79.2%. The equatorial region 19 has a surface coverage $S_e$ 86.6%.

In one aspect, the edge angles of all of the dimples having a circular plan shape and all of the dimples having an elliptical plan shape can have a standard deviation of at least 0.30°. In one aspect, the edge angles of all of the dimples having a circular plan shape and all of the dimples having an elliptical plan shape can have a standard deviation of at least 0.50°.

In one aspect, a difference between a minimum edge angle and a maximum edge angle among all of the dimples having a circular plan shape can be at least 0.50°, or at least 1.0°. In one aspect, a difference between a minimum edge angle and a maximum edge angle among all of the dimples having an elliptical circular plan shape can be at least 0.25°, or at least 0.30°.

In one aspect, the chord depths of all of the dimples having the circular plan shape and all of the dimples having the elliptical plan shape can have a standard deviation of no greater than 0.00020 inches, or no greater than 0.00015 inches, or no greater than 0.00013 inches.

In one aspect, an average chord depth of all of the dimples having the circular plan shape can be at least 0.0005 inches greater than an average chord depth of all of the dimples having the elliptical plan shape.

In one aspect, the chord depth of all of the dimples having a circular plan shape can be identical, and the chord depth of all of the dimples having an elliptical plan shape can be identical.

In one aspect, an average chord depth among all of the dimples having the circular plan shape and the elliptical plan shape can be no greater than 0.0055 inches. In one aspect, an average chord depth among all of the dimples having the circular plan shape and the elliptical plan shape can be no greater than 0.0053 inches. In one aspect, an average chord depth among all of the dimples having the circular plan shape and the elliptical plan shape can be no greater than 0.0051 inches.

In one aspect, the embodiments of FIGS. 11A-11D and 12A-12D allows for shallower dimples without sacrificing dimple volume. In one aspect, this configuration provides an improved ability for forming the cover on the golf ball, particularly during various formation techniques, such as reaction injection-molding (RIM), retractable pin injection-molding (RPIM), liquid injection-molding, compression molding, casting, as well as other formation techniques. The embodiments of FIGS. 11A-11D and 12A-12D, in particular, can maximize the distance between the golf ball sub-assembly (or core, or cased core) and the cover while simultaneously maintaining optimal aerodynamic characteristics with respect to the dimple volume. In one aspect, the present disclosure allows for the use of relatively larger golf ball sub-assemblies while maintaining optimal dimple volumes, thereby reducing flow impingement issues that may arise during certain formation techniques.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of dimples disposed on a spherical outer surface thereof and having a non-planar parting line, wherein:

the plurality of dimples comprising at least three different dimple diameters, including a minimum dimple diameter, a maximum dimple diameter, and at least one additional dimple diameter;

the golf ball consists of two hemispheres separated by an equator, the two hemispheres having substantially identical dimple arrangements;

each hemispherical dimple arrangement consists of four triangular sections that are defined by projecting four faces of a square pyramid onto the hemisphere such that each of the four triangular sections is defined by a border consisting of a linear equatorial edge which corresponds to a portion of the equator of the golf ball and two linear side edges connecting each end of the equatorial edge to a pole of the golf ball;

the four triangular sections of each hemisphere are substantially identical in size and dimple arrangement;

the dimple arrangement within each of the four triangular sections is not rotationally symmetric about a center of the respective triangular section;

wherein at least some dimples of the plurality of dimples have a catenary cross-sectional profile defined by x-y coordinates, wherein x=0 corresponds to a central axis of the catenary cross-sectional profile and y=0 corresponds to a minimum of the catenary cross-sectional profile, and the catenary cross-sectional profile is defined by:

$$y = \frac{d_c(\cosh(SF \cdot x) - 1)}{\cosh\left(SF \cdot \frac{D}{2}\right) - 1}$$

where D is a diameter of the dimple having the catenary cross-sectional profile, $d_e$ is a chord depth of the dimples having the catenary cross-sectional profile, and SF is a shape factor of the dimples having the catenary cross-sectional profile; and the shape factor for all of the plurality of dimples having the catenary cross-sectional profile is at least 20;

wherein each of the four triangular sections is divided into:

a polar region from latitude angle 0 degrees to latitude angle 30 degrees, and the polar region has a dimple surface coverage $S_p$;

an intermediate region from latitude angle 30 degrees to latitude angle 60 degrees, and the intermediate region has a dimple surface coverage $S_i$; and an equatorial region from latitude angle 60 degrees to latitude angle 90 degrees, and the equatorial region has a dimple surface coverage $S_e$;

where latitude angle 0 degrees is a pole and latitude angle 90 degrees is an equator; and wherein $S_p<S_i<S_e$ and $S_p \geq 70.0\%$;

wherein all of the plurality of dimples have the catenary cross-sectional profile;

wherein a first subset of the plurality of dimples has a circular plan shape and a second subset of the plurality of dimples has an elliptical plan shape; and wherein the second subset of the plurality of dimples includes dimples having at least two different diameters and having at least two different edge angles.

2. The golf ball according to claim 1, wherein a majority of the dimples of the first subset of the plurality of dimples have an identical chord depth.

3. The golf ball according to claim 1, wherein the first subset of the plurality of dimples includes dimples having at least five different diameters and having at least five different edge angles.

4. The golf ball according to claim 1, wherein the second subset of the plurality of dimples are disposed in a polar region defined from latitude angle 0 degrees to latitude angle 30 degrees.

5. The golf ball according to claim 1, wherein the first subset of the plurality of dimples includes a first quantity of dimples and the second subset of the plurality of dimples includes a second quantity of dimples, wherein the first quantity is at least 15 times greater than the second quantity.

6. The golf ball according to claim 5, wherein the first quantity is 330 and the second quantity is 16.

7. The golf ball according to claim 1, wherein a standard deviation of chord depths among all of the dimples of the first subset of the plurality of dimples and all of the dimples of the second subset of the plurality of dimples is no greater than 0.00020 inches.

8. A golf ball having a plurality of dimples disposed on a spherical outer surface thereof and having a non-planar parting line, wherein:

the plurality of dimples comprising at least three different dimple diameters, including a minimum dimple diameter, a maximum dimple diameter, and at least one additional dimple diameter;

the golf ball consists of two hemispheres separated by an equator, the two hemispheres having substantially identical dimple arrangements;

each hemispherical dimple arrangement consists of four triangular sections that are defined by projecting four faces of a square pyramid onto the hemisphere such that each of the four triangular sections is defined by a border consisting of a linear equatorial edge which corresponds to a portion of the equator of the golf ball and two linear side edges connecting each end of the equatorial edge to a pole of the golf ball;

the four triangular sections of each hemisphere are substantially identical in size and dimple arrangement;

the dimple arrangement within each of the four triangular sections is not rotationally symmetric about a center of the respective triangular section;

wherein at least some dimples of the plurality of dimples have a catenary cross-sectional profile defined by x-y coordinates, wherein x=0 corresponds to a central axis of the catenary cross-sectional profile and y=0 corresponds to a minimum of the catenary cross-sectional profile, and the catenary cross-sectional profile is defined by:

$$y = \frac{d_c(\cosh(SF \cdot x) - 1)}{\cosh\left(SF \cdot \frac{D}{2}\right) - 1}$$

where D is a diameter of the dimple having the catenary cross-sectional profile, $d_e$ is a chord depth of the dimples having the catenary cross-sectional profile, and SF is a shape factor of the dimples having the catenary cross-sectional profile; and the shape factor for all of the plurality of dimples having the catenary cross-sectional profile is at least 20, and wherein the plurality of dimples having the catenary cross-sectional profile each have an identical shape factor SF, and wherein a first subset of the plurality of dimples has a circular plan shape and a second subset of the plurality of dimples has an elliptical plan shape, and wherein the first subset of the plurality of dimples includes a first quantity of dimples and the second subset of the plurality of dimples includes a second quantity of dimples, wherein the first quantity is at least 15 times greater than the second quantity.

9. A golf ball having a plurality of dimples disposed on a spherical outer surface thereof and having a non-planar parting line, wherein:

the plurality of dimples comprising at least three different dimple diameters, including a minimum dimple diameter, a maximum dimple diameter, and at least one additional dimple diameter;

the golf ball consists of two hemispheres separated by an equator, the two hemispheres having substantially identical dimple arrangements;

each hemispherical dimple arrangement consists of four triangular sections that are defined by projecting four faces of a square pyramid onto the hemisphere such that each of the four triangular sections is defined by a border consisting of a linear equatorial edge which corresponds to a portion of the equator of the golf ball and two linear side edges connecting each end of the equatorial edge to a pole of the golf ball;

the four triangular sections of each hemisphere are substantially identical in size and dimple arrangement;

the dimple arrangement within each of the four triangular sections is not rotationally symmetric about a center of the respective triangular section;

wherein at least some dimples of the plurality of dimples have a catenary cross-sectional profile defined by x-y coordinates, wherein x=0 corresponds to a central axis of the catenary cross-sectional profile and y=0 corresponds to a minimum of the catenary cross-sectional profile, and the catenary cross-sectional profile is defined by:

$$y = \frac{d_c(\cosh(SF \cdot x) - 1)}{\cosh\left(SF \cdot \frac{D}{2}\right) - 1}$$

where D is a diameter of the dimple having the catenary cross-sectional profile, $d_e$ is a chord depth of the dimples having the catenary cross-sectional profile, and SF is a shape factor of the dimples having the catenary cross-sectional profile; and the shape factor for all of the plurality of dimples having the catenary cross-sectional profile is at least 20;

wherein each of the four triangular sections is divided into:

a polar region from latitude angle 0 degrees to latitude angle 30 degrees, and the polar region has a dimple surface coverage $S_p$;

an intermediate region from latitude angle 30 degrees to latitude angle 60 degrees, and the intermediate region has a dimple surface coverage $S_i$; and an equatorial region from latitude angle 60 degrees to latitude angle 90 degrees, and the equatorial region has a dimple surface coverage $S_e$;

where latitude angle 0 degrees is a pole and latitude angle 90 degrees is an equator; and wherein $S_p<S_i<S_e$ and $S_p \geq 70.0\%$;

wherein all of the plurality of dimples have the catenary cross-sectional profile;

wherein a first subset of the plurality of dimples has a circular plan shape and a second subset of the plurality of dimples has an elliptical plan shape; and wherein a standard deviation of edge angles among all of the dimples of the first subset of the plurality of dimples and all of the dimples of the second subset of the plurality of dimples is at least 0.50°.

10. The golf ball according to claim 9, wherein a majority of the dimples of the first subset of the plurality of dimples have an identical chord depth.

11. The golf ball according to claim 9, wherein the first subset of the plurality of dimples includes dimples having at least five different diameters and having at least five different edge angles.

12. The golf ball according to claim 9, wherein the first subset of the plurality of dimples includes a first quantity of dimples and the second subset of the plurality of dimples includes a second quantity of dimples, wherein the first quantity is at least 15 times greater than the second quantity.

* * * * *